US010526926B2

(12) United States Patent
Andrisani

(10) Patent No.: US 10,526,926 B2
(45) Date of Patent: Jan. 7, 2020

(54) ROCKER ARM HAVING OIL RELEASE VALVE THAT OPERATES AS AN ACCUMULATOR

(71) Applicant: Eaton Srl, Turin (IT)

(72) Inventor: Nicola Andrisani, Cumiana (IT)

(73) Assignee: Eaton Srl, Turin (IT)

( * ) Notice: Subject to any disclaimer, the term of this patent is extended or adjusted under 35 U.S.C. 154(b) by 27 days.

(21) Appl. No.: 15/814,688

(22) Filed: Nov. 16, 2017

(65) Prior Publication Data

US 2018/0073401 A1 Mar. 15, 2018

Related U.S. Application Data

(63) Continuation of application No. PCT/EP2015/060899, filed on May 18, 2015.

(51) Int. Cl.

| | |
|---|---|
| ***F01L 1/20*** | (2006.01) |
| ***F01L 1/18*** | (2006.01) |
| ***F01L 13/06*** | (2006.01) |
| ***F01L 1/24*** | (2006.01) |
| ***F01L 9/02*** | (2006.01) |

(52) U.S. Cl.

CPC ..... *F01L 1/18* (2013.01); *F01L 1/24* (2013.01); *F01L 9/02* (2013.01); *F01L 13/065* (2013.01); *F01L 2760/003* (2013.01)

(58) Field of Classification Search

CPC ..... F01L 13/06; F01L 13/065; F01L 1/24; F01L 1/18; F01L 9/02; F01L 2760/003

See application file for complete search history.

(56) References Cited

U.S. PATENT DOCUMENTS

| | | | |
|---|---|---|---|
| 3,220,392 | A | 11/1965 | Cummins |
| 3,332,405 | A | 7/1967 | Haviland |
| 3,367,312 | A | 2/1968 | Einar |
| 3,520,287 | A | 7/1970 | Calvin |
| 3,786,792 | A | 1/1974 | Pelizzoni et al. |

(Continued)

FOREIGN PATENT DOCUMENTS

| | | |
|---|---|---|
| CN | 201255016 | 6/2009 |
| CN | 201666172 U | 12/2010 |

(Continued)

OTHER PUBLICATIONS

European Search Report for EP Application No. 15 723 228.1 dated Sep. 7, 2018, 5 pages.

(Continued)

*Primary Examiner* — Zelalem Eshete
(74) *Attorney, Agent, or Firm* — RMCK Law Group PLC

(57) ABSTRACT

An exhaust valve rocker arm assembly operable in a combustion engine mode and an engine braking mode can include a rocker shaft and a rocker arm. The rocker shaft can define a pressurized oil supply conduit. The rocker arm can receive the rocker shaft and is configured to rotate around the rocker shaft. The rocker arm can have an oil supply passage defined therein. A valve bridge can engage a first exhaust valve and a second exhaust valve. An accumulator assembly can be disposed in the rocker arm and includes an accumulator piston that translates within the accumulator piston housing between closed and open positions. A predetermined amount of oil is stored in the accumulator assembly.

19 Claims, 17 Drawing Sheets

(56) References Cited

U.S. PATENT DOCUMENTS 3,809,033 A 5/1974 Cartledge
4,150,640 A 4/1979 Egan
4,192,263 A 3/1980 Kitagawa et al.
4,384,558 A 5/1983 Johnson
4,423,712 A 1/1984 Mayne et al.
4,473,047 A 9/1984 Jakuba et al.
4,475,500 A 10/1984 Bostelman
4,498,432 A 2/1985 Hara et al.
4,510,900 A 4/1985 Quenneville
4,523,551 A 6/1985 Arai et al.
4,592,319 A 6/1986 Meistrick
4,616,607 A 10/1986 Kodama et al.
4,644,914 A 2/1987 Morita et al.
4,646,690 A 3/1987 Hayashi
4,648,365 A 3/1987 Bostelman
4,697,558 A 10/1987 Meneely
4,706,624 A 11/1987 Meistrick et al.
4,706,625 A 11/1987 Meistrick et al.
4,711,210 A 12/1987 Reichenbach
4,724,822 A 2/1988 Bonvallet
4,793,307 A 12/1988 Quenneville et al.
5,036,810 A 8/1991 Meneely
5,048,480 A 9/1991 Price
5,193,497 A 3/1993 Hakansson
5,195,489 A 3/1993 Reich
5,201,290 A 4/1993 Hu
5,335,636 A 8/1994 Bilei et al.
5,357,926 A 10/1994 Hu
5,365,916 A 11/1994 Freiburg et al.
5,379,737 A 1/1995 Hu
5,386,809 A 2/1995 Reedy et al.
5,477,824 A 12/1995 Reedy
5,479,896 A 1/1996 Freiburg et al.
5,507,261 A 4/1996 Johnson, Jr.
5,564,385 A 10/1996 Hakansson
5,609,133 A 3/1997 Hakansson
5,615,653 A 4/1997 Faletti et al.
5,622,146 A 4/1997 Spell
5,626,116 A 5/1997 Reedy et al.
5,647,318 A 7/1997 Feucht et al.
5,680,841 A 10/1997 Hu
5,730,102 A 3/1998 Arnold et al.
5,735,242 A 4/1998 Kahlenbeck et al.
5,758,620 A 6/1998 Warner
5,813,231 A 9/1998 Faletti et al.
5,829,397 A * 11/1998 Vorih ..... F01L 1/181 123/90.12
5,839,453 A 11/1998 Hu
5,890,469 A 4/1999 Håkansson et al.
5,934,263 A 8/1999 Russ et al.
5,937,807 A 8/1999 Peters et al.
5,975,251 A 11/1999 McCarthy
5,996,550 A 12/1999 Israel et al.
6,000,374 A 12/1999 Cosma et al.
6,065,434 A 5/2000 Schmidt
6,152,104 A 11/2000 Vorih et al.
6,178,946 B1 1/2001 Matthews et al.
6,234,143 B1 5/2001 Bartel et al.
6,253,730 B1 7/2001 Gustafson
6,293,237 B1 9/2001 Vorih
6,354,265 B1 3/2002 Hampton et al.
6,386,160 B1 5/2002 Meneely et al.
6,394,050 B1 5/2002 McCarthy et al.
6,415,752 B1 7/2002 Janak
6,422,186 B1 7/2002 Vanderpoel
6,450,144 B2 9/2002 Janak et al.
6,474,296 B2 11/2002 Cornell et al.
6,510,824 B2 1/2003 Vorih et al.
6,591,795 B2 7/2003 Janak
6,594,996 B2 7/2003 Yang
6,691,674 B2 2/2004 McCarthy et al.
6,694,933 B1 2/2004 Lester
6,732,686 B1 5/2004 Maeda et al.
6,854,433 B2 2/2005 Vanderpoel
6,883,492 B2 4/2005 Vanderpoel et al.
7,013,867 B2 3/2006 Rammer et al.
RE39,258 E 9/2006 Cosma et al.
7,156,062 B2 1/2007 Vanderpoel
7,162,996 B2 1/2007 Yang
7,350,491 B2 4/2008 Stretch et al.
7,392,772 B2 7/2008 Janak et al.
7,484,483 B2 2/2009 Yang et al.
7,500,466 B2 3/2009 Noss et al.
7,559,300 B2 7/2009 Ruggiero
7,600,497 B2 10/2009 Vanderpoel
7,673,600 B2 3/2010 Yang
7,712,449 B1 5/2010 Schwoerer
7,793,624 B2 9/2010 Janak et al.
7,823,553 B2 11/2010 Meistrick
7,827,958 B2 11/2010 Dietrich et al.
7,882,810 B2 2/2011 Vanderpoel et al.
7,905,208 B2 3/2011 Ruggiero et al.
7,971,569 B2 7/2011 Meistrick et al.
8,087,392 B2 1/2012 Swanbon et al.
8,151,763 B2 4/2012 Meistrick et al.
8,156,921 B2 4/2012 Meacock
8,230,831 B2 7/2012 Persson et al.
8,434,451 B2 5/2013 Yoon et al.
8,516,984 B2 8/2013 Schwoerer
8,528,508 B2 9/2013 Meistrick et al.
8,573,171 B2 11/2013 Cecur et al.
8,578,901 B2 11/2013 Ruggiero et al.
8,627,791 B2 1/2014 Janak et al.
8,726,863 B2 5/2014 Meistrick et al.
8,776,738 B2 7/2014 Vorih et al.
8,820,276 B2 9/2014 Vorih et al.
8,851,048 B2 10/2014 Meistrick
8,863,726 B2 10/2014 Ruggiero et al.
8,936,006 B2 1/2015 Groth et al.
8,991,341 B2 3/2015 Forestier
9,016,249 B2 4/2015 Roberts et al.
9,068,748 B2 6/2015 Hoke
9,200,541 B2 12/2015 Roberts et al.
9,429,051 B2 8/2016 Meneely et al.
9,562,448 B2 2/2017 Meneely et al.
9,702,276 B2 7/2017 Baltrucki et al.
9,885,263 B2 2/2018 Meneely et al.
2001/0027773 A1* 10/2001 Janak ..... F01L 1/181 123/321
2003/0024501 A1 2/2003 McCarthy et al.
2009/0266317 A1 10/2009 Meacock
2010/0065019 A1 3/2010 Yang
2010/0108007 A1 5/2010 Meistrick et al.
2010/0319657 A1 12/2010 Dodi et al.
2011/0186008 A1 8/2011 Zapf
2011/0220052 A1 9/2011 Sailer et al.
2012/0024260 A1 2/2012 Groth et al.
2012/0048232 A1 3/2012 Meistrick
2012/0298057 A1 11/2012 Janak et al.
2013/0000573 A1 1/2013 Sailer et al.
2013/0269652 A1 10/2013 Toth et al.
2013/0269653 A1 10/2013 Yang
2013/0319370 A1 12/2013 Yang
2014/0020644 A1 1/2014 Roberts et al.
2014/0020654 A1 1/2014 Yang
2014/0048024 A1 2/2014 Itoafa et al.
2014/0083381 A1 3/2014 Roberts et al.
2014/0109848 A1 4/2014 Janak et al.
2014/0238015 A1 8/2014 Roberts et al.
2014/0238324 A1 8/2014 Janak et al.
2014/0251266 A1 9/2014 Emmons et al.
2015/0122222 A1 5/2015 Yoon et al.
2015/0144096 A1 5/2015 Meneely et al.
2015/0204250 A1 7/2015 Forestier
2015/0252694 A1 9/2015 Gustafson et al.

FOREIGN PATENT DOCUMENTS

CN 203626910 U 6/2014
CN 203796350 U 8/2014
DE 10250771 A1 5/2004
DE 102012100963 A1 8/2012
EP 0543210 A1 5/1993
EP 1526257 B1 8/2009

(56) References Cited

FOREIGN PATENT DOCUMENTS

| | | | |
|---|---|---|---|
| EP | 2321502 | B1 | 3/2012 |
| EP | 2438276 | A1 | 4/2012 |
| EP | 2444602 | A1 | 4/2012 |
| EP | 2625395 | A1 | 8/2013 |
| EP | 2598727 | B1 | 10/2015 |
| GB | 2318391 | A | 4/1998 |
| JP | S63272929 | A | 11/1988 |
| JP | H09177526 | A | 7/1997 |
| JP | 2000045738 | A | 2/2000 |
| JP | 2011149398 | A | 8/2011 |
| WO | 9108381 | A1 | 6/1991 |
| WO | 0146578 | A1 | 6/2001 |
| WO | 2010078280 | A2 | 7/2010 |
| WO | 2012113126 | A1 | 8/2012 |
| WO | 2013014491 | A1 | 1/2013 |
| WO | 2013044091 | A1 | 3/2013 |
| WO | 2014085572 | A1 | 6/2014 |
| WO | 2014145544 | A1 | 9/2014 |
| WO | 2015017057 | A1 | 2/2015 |

OTHER PUBLICATIONS

International Search Report and Written Opinion for International Application No. PCT/EP2015/060899 dated Jan. 18, 2016, 10 pages.

* cited by examiner

ROCKER ARM HAVING OIL RELEASE VALVE THAT OPERATES AS AN ACCUMULATOR

CROSS-REFERENCE TO RELATED APPLICATIONS

This application is a continuation of International Application No. PCT/EP2015/060899 filed May 18, 2015, which is incorporated by reference in its entirety as if set forth herein.

FIELD

The present disclosure relates generally to a rocker arm assembly for use in a valve train assembly and more particularly to a rocker arm assembly that has an oil release valve that operates as an accumulator.

BACKGROUND

Compression engine brakes can be used as auxiliary brakes, in addition to wheel brakes, on relatively large vehicles, for example trucks, powered by heavy or medium duty diesel engines. A compression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor which slows the vehicle.

In a typical valve train assembly used with a compression engine brake, the exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it. A hydraulic lash adjuster may also be provided in the valve train assembly to remove any lash or gap that develops between the components in the valve train assembly.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

An exhaust valve rocker arm assembly operable in a combustion engine mode and an engine braking mode can include a rocker shaft and a rocker arm. The rocker shaft can define a pressurized oil supply conduit. The rocker arm can receive the rocker shaft and is configured to rotate around the rocker shaft. The rocker arm can have an oil supply passage and an accumulator piston housing defined therein. A valve bridge can engage a first exhaust valve and a second exhaust valve. A hydraulic lash adjuster assembly can be disposed on the rocker arm having a first plunger body movable between a first position and a second position. In the first position, the first plunger body extends rigidly for cooperative engagement with the valve bridge. A check valve can be disposed on the rocker arm and have an actuator that selectively releases pressure in the hydraulic lash adjuster. An accumulator assembly can be disposed in the rocker arm. The accumulator assembly can include an accumulator piston that translates within the accumulator piston housing between closed and open positions. The accumulator assembly can be configured to store a predetermined amount of oil when the first plunger body moves toward the first position.

According to other features, the accumulator assembly further comprises an accumulator spring that biases the accumulator piston toward the closed position. In the closed position, oil is inhibited from entering the accumulator piston housing. The accumulator assembly can further define a release hole formed in the rocker arm. The release hole fluidly connects with the piston housing. Oil is released from the piston housing through the release hole upon the accumulator piston translating a predetermined amount.

In other features, in the engine braking mode, pressurized oil is communicated through the pressurized oil supply conduit, through the rocker arm oil supply passage and against the actuator such that the first plunger occupies the first position and acts on the valve bridge during rotation of the rocker arm to a first angle opening the first valve a predetermined distance while the second valve remains closed.

According to additional features, the hydraulic lash adjuster assembly is at least partially received by a first bore defined on the rocker arm. The hydraulic lash adjuster assembly further comprises a second plunger body that is at least partially received by the first plunger body. The second plunger body can define a valve seat. The check valve can be disposed between the first and second plunger bodies. The check valve can further comprise a check ball that selectively seats against the valve seat on the second plunger body.

According to other features, the actuator can further comprise a needle having a longitudinal pin portion and a disk portion. In the engine braking mode, pressurized oil acts against the disk portion moving the longitudinal pin portion a distance away from the check ball. The disk portion of the actuator can be received in a second bore defined in the rocker arm. The first and second bores can be collinear.

According to still other features, rotation of the rocker arm to a second predetermined angle disconnects the oil supply passage from the pressurized oil supply conduit. The rocker shaft can further define a vent channel. Rotation of the rocker arm to a third predetermined angle connects the oil supply passage to a vent channel releasing the oil pressure from the actuator. A spigot can be disposed on the rocker arm. In the engine braking mode, subsequent to the opening of the first valve the predetermined distance, further rotation of the rocker arm causes the spigot to move the valve bridge and open the second valve while further opening the first valve. The spigot can be configured to slidably translate along a passage defined in the rocker arm prior to moving the valve bridge.

An exhaust valve rocker arm assembly operable in a combustion engine mode and an engine braking mode according to additional features can include a rocker shaft that defines a pressurized oil supply conduit. A rocker arm can receive the rocker shaft and be configured to rotate around the rocker shaft. The rocker arm can have an oil supply passage and an accumulator piston housing defined therein. A valve bridge can engage a first exhaust valve and a second exhaust valve. A first plunger body can be movable between a first position and a second position. In the first position, the first plunger body extends rigidly for cooperative engagement with the valve bridge. An actuator can selectively release pressure acting against the first plunger body. An accumulator assembly can be disposed in the rocker arm. The accumulator assembly can include an accumulator piston that translates within the accumulator piston housing between closed and open positions. The accumulator assembly can be configured to store a predetermined amount of oil when the first plunger body moves toward the first position.

According to other features, the accumulator assembly further comprises an accumulator spring that biases the accumulator piston toward the closed position. In the closed position, oil is inhibited from entering the accumulator piston housing. The accumulator assembly can further define a release hole formed in the rocker arm. The release hole fluidly connects with the piston housing. Oil is released from the piston housing through the release hole upon the accumulator piston translating a predetermined amount.

In other features, while in the engine braking mode, pressurized oil can be communicated through the pressurized oil supply conduit, through the rocker arm oil supply passage and against the actuator such that the first plunger occupies the first position and acts on the valve bridge during rotation of the rocker arm to a first angle opening the first valve a predetermined distance while the second valve remains closed.

According to other features, rotation of the rocker arm to a second predetermined angle disconnects the oil supply passage from the pressurized oil supply circuit. The rocker shaft can further define a vent channel. Rotation of the rocker arm to a third predetermined angle connects the oil supply passage to a vent channel releasing the oil pressure from the actuator. A spigot can be disposed on the rocker arm. In the engine braking mode, subsequent to the opening of the first valve the predetermined distance, further rotation of the rocker arm causes the spigot to move the valve bridge and open the second valve while further opening the first valve. A second plunger body can be at least partially received by the first plunger body. The second plunger body can define a valve seat. A check valve can be disposed between the first and second plunger bodies. The check valve can further include a check ball that selectively seats against the valve seat on the second plunger body.

According to additional features, the actuator can further comprise a needle having a longitudinal pin portion and a disk portion. In the engine braking mode, pressurized oil acts against the disk portion moving the longitudinal pin portion a distance away from the check ball. The disk portion of the actuator can be received in a second bore defined in the rocker arm. The first and second bores can be collinear.

BRIEF DESCRIPTION OF THE DRAWINGS

The present disclosure will become more fully understood from the detailed description and the accompanying drawings, wherein.

DETAILED DESCRIPTION

Figure 1:
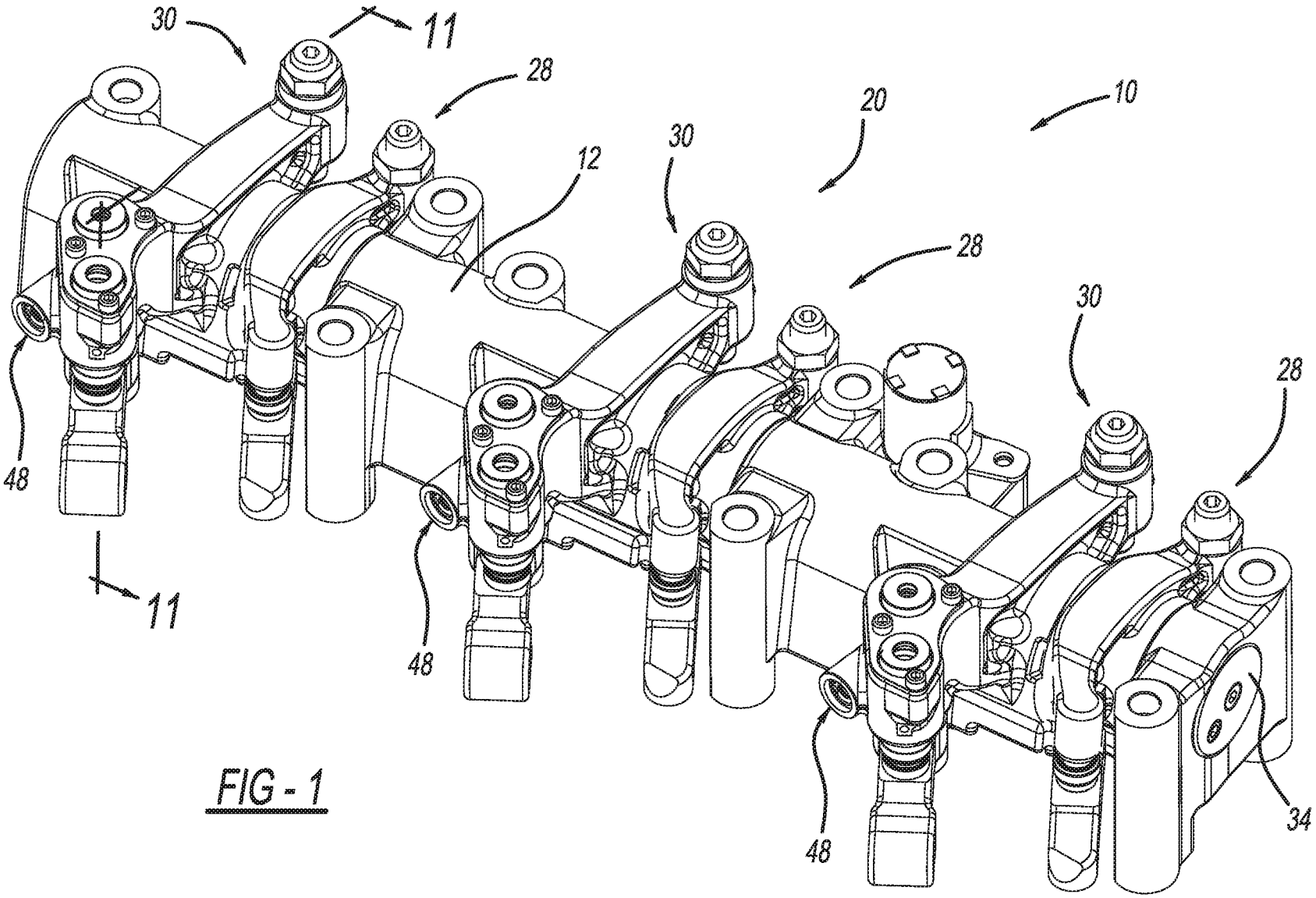
FIG. 1 is a perspective view of a partial valve train assembly incorporating a rocker arm assembly including an exhaust valve rocker arm assembly for use with compression engine braking and constructed in accordance to one example of the present disclosure.

With initial reference to FIG. 1, a partial valve train assembly constructed in accordance to one example of the present disclosure is shown and generally identified at reference 10. The partial valve train assembly 10 utilizes engine braking and is shown configured for use in a three-cylinder bank portion of a six-cylinder engine. It will be appreciated however that the present teachings are not so limited. In this regard, the present disclosure may be used in any valve train assembly that utilizes engine braking.

The partial valve train assembly 10 can include a rocker assembly housing 12 that supports a rocker arm assembly 20 having a series of intake valve rocker arm assemblies 28 and a series of exhaust valve rocker arm assemblies 30. A rocker shaft 34 is received by the rocker housing 30. As will be described in detail herein, the rocker shaft 34 cooperates with the rocker arm assembly 20 and more specifically to the exhaust valve rocker arm assemblies 30 to communicate oil to the exhaust valve rocker arm assemblies 30 during engine braking.

Figure 2:
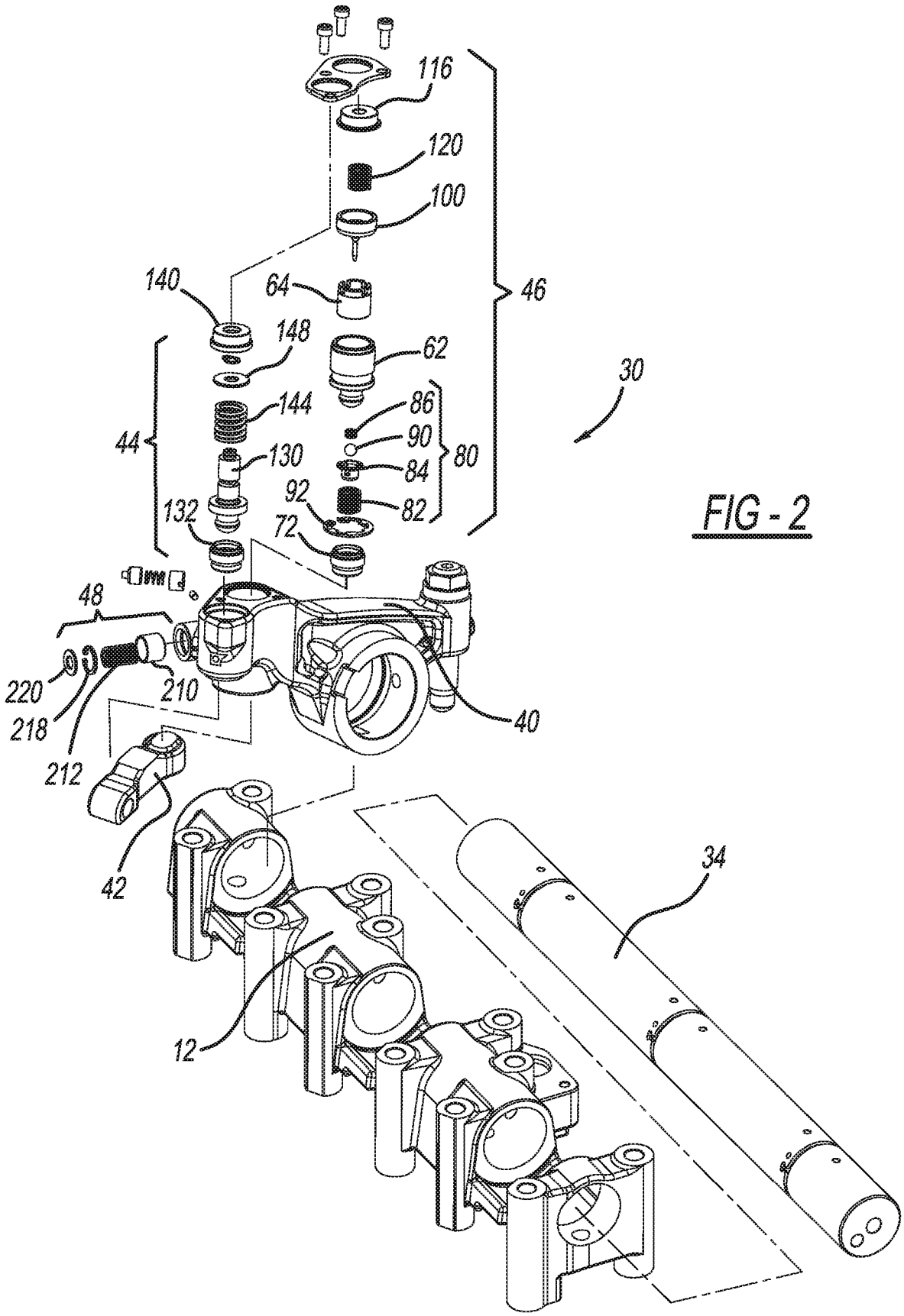
FIG. 2 is an exploded view of an exhaust valve rocker arm assembly of the valve train assembly of FIG. 1.
Figure 3:
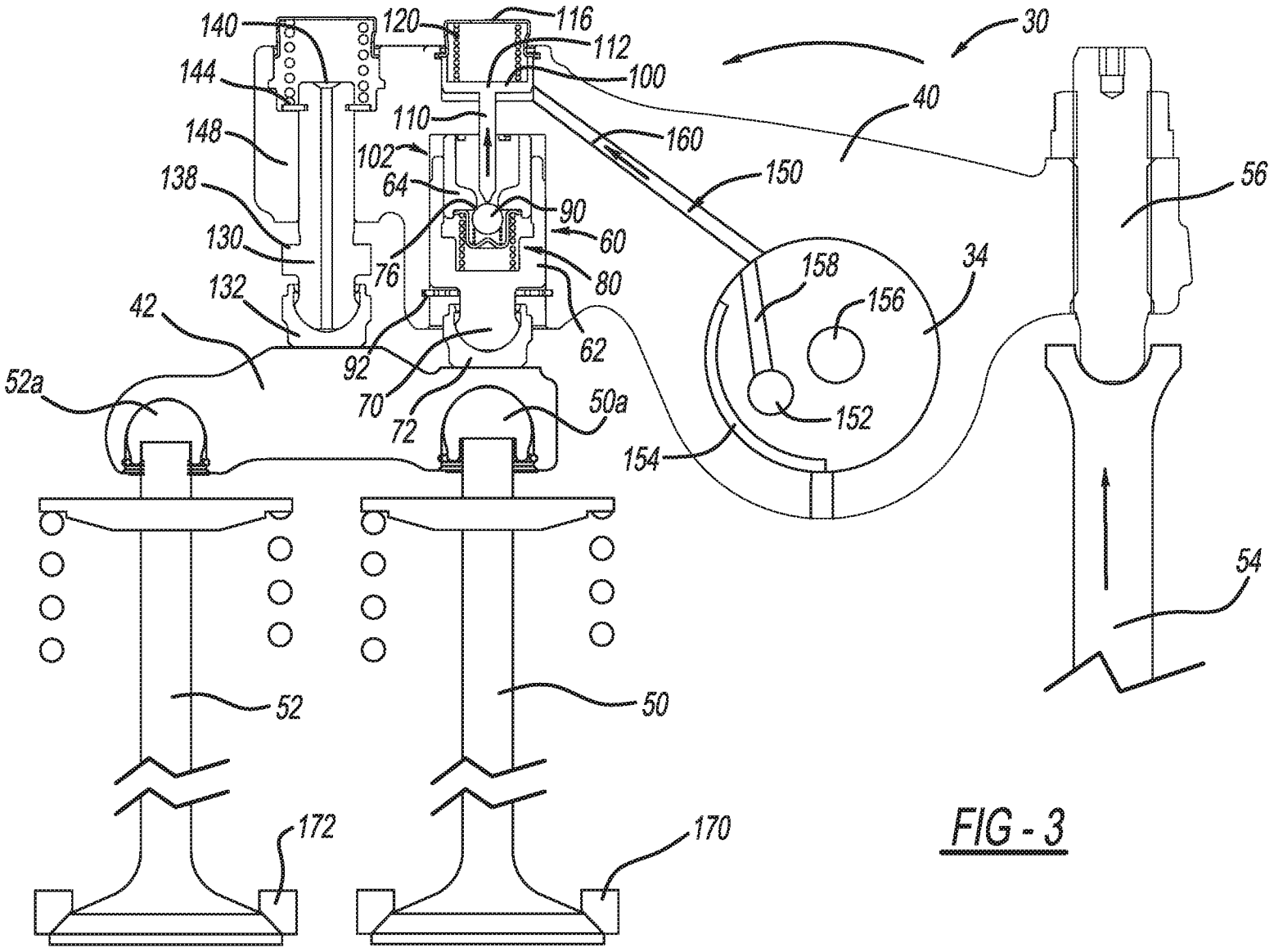
FIG. 3 is a schematic illustration of the exhaust valve rocker arm assembly of FIG. 2 and shown in an engine brake mode.

With further reference now to FIGS. 2 and 3, an exhaust valve rocker arm assembly 30 will be further described. The exhaust valve rocker arm assembly 30 can generally include a rocker arm 40, a valve bridge 42, a spigot assembly 44, a hydraulic lash adjuster (HLA) assembly 46 and an accumulator assembly 48. The valve bridge 42 engages a first and second exhaust valve 50 and 52 (FIG. 3) associated with a cylinder of an engine (not shown). The first and second exhaust valves 50 and 52 have a corresponding elephant foot or E-foot 50*a* and 52*a*. The E-feet 50*a* and 52*a* allow the valve bridge 42 to move without creating any side load on the corresponding valve stem 50 and 52. The E-foot 50*a* is spherical. The E-foot 52*a* is cylindrical. A pushrod 54 (FIG. 3) moves upward and downward based on a lift profile of a cam shaft (not shown). Upward movement of the pushrod 54 pushes an arm 56 fixed to the rocker arm 40 and in turn causes the rocker arm 40 to rotate counter-clockwise around the rocker shaft 34.

Figure 4:
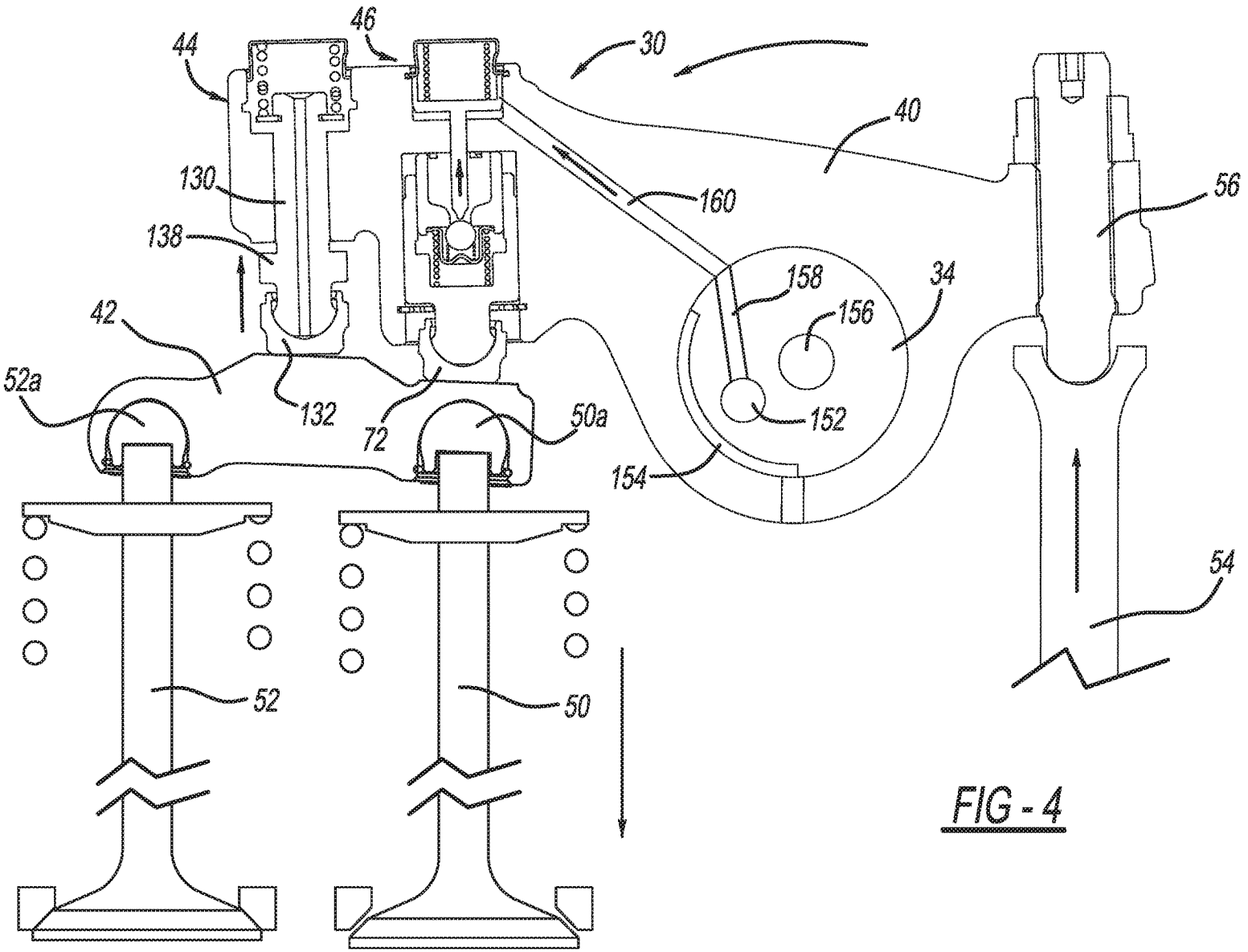
FIG. 4 is a schematic illustration of the exhaust valve rocker arm assembly of FIG. 3 and shown in engine brake mode with initial rotation of the rocker arm in the counter-clockwise direction and a first exhaust valve beginning to open.

The HLA assembly 46 can comprise a plunger assembly 60 including a first plunger body 62 and a second plunger body 64. The second plunger body 64 can be partially received by the first plunger body 62. The plunger assembly 60 is received by a first bore 66 defined in the rocker arm 40. The first plunger body 64 can have a first closed end 68 that defines a first spigot 70 which is received in a first socket 72 that acts against the valve bridge 42. The second plunger body 64 has an opening that defines a valve seat 76 (FIG. 4). A check ball assembly 80 can be positioned between the first and second plunger bodies 62 and 64. The check ball assembly 80 can include a first biasing member 82, a cage 84, a second biasing member 86 and a check ball 90. A snap ring 92 nests in a radial groove provided in the first bore 66 of the rocker arm 40. The snap ring 92 retains the first plunger body 62 in the first bore 66.

An actuator or needle 100 is received in a second bore 104 of the rocker arm 40. The needle 100 acts as an actuator that selectively releases pressure in the HLA assembly 46. The actuator 100, the check ball assembly 80 and the valve seat 76 collectively operate as a check valve 102 (FIG. 3). The needle 100 includes a longitudinal pin portion 110 and an upper disk portion 112. A first cap 116 is fixed to the rocker arm 40 at the second bore 104 and captures a biasing member 120 therein. The biasing member 120 acts between the first cap 116 and the upper disk portion 112 of the needle 100. In the example shown, the biasing member 120 biases the needle 100 downwardly as viewed in FIG. 3.

The spigot assembly 44 will be described in greater detail. The spigot assembly 44 can generally include a second spigot 130 having a distal end that is received by a second socket 132 and a proximal end that extends into a third bore 136 defined in the rocker arm 40. A collar 138 can extend from an intermediate portion of the second spigot 130. The second spigot 130 can extend through a passage 139 formed through the rocker arm 40. A second cap 140 is fixed to the rocker arm 40 at the third bore 136 and captures a biasing member 144 therein. The biasing member 144 acts between the second cap 140 and a snap ring 148 fixed to the proximal end of the second spigot 130. As will be described, the second spigot 130 remains in contact with the rocker arm 40 and is permitted to translate along its axis within the passage 139.

Figure 10:
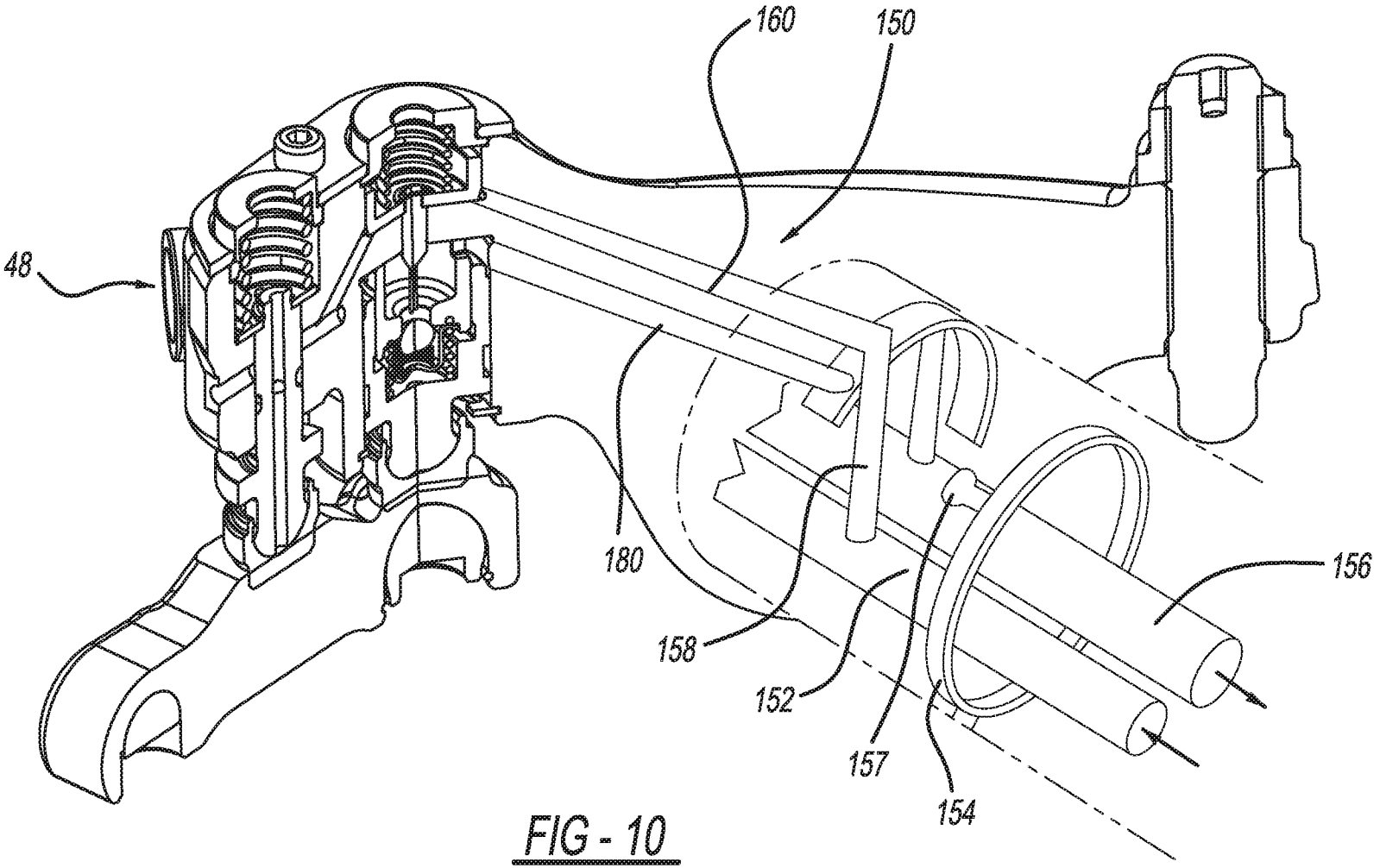
FIG. 10 is a phantom perspective view of an oil circuit of the exhaust rocker arm assembly.
Figure 11:
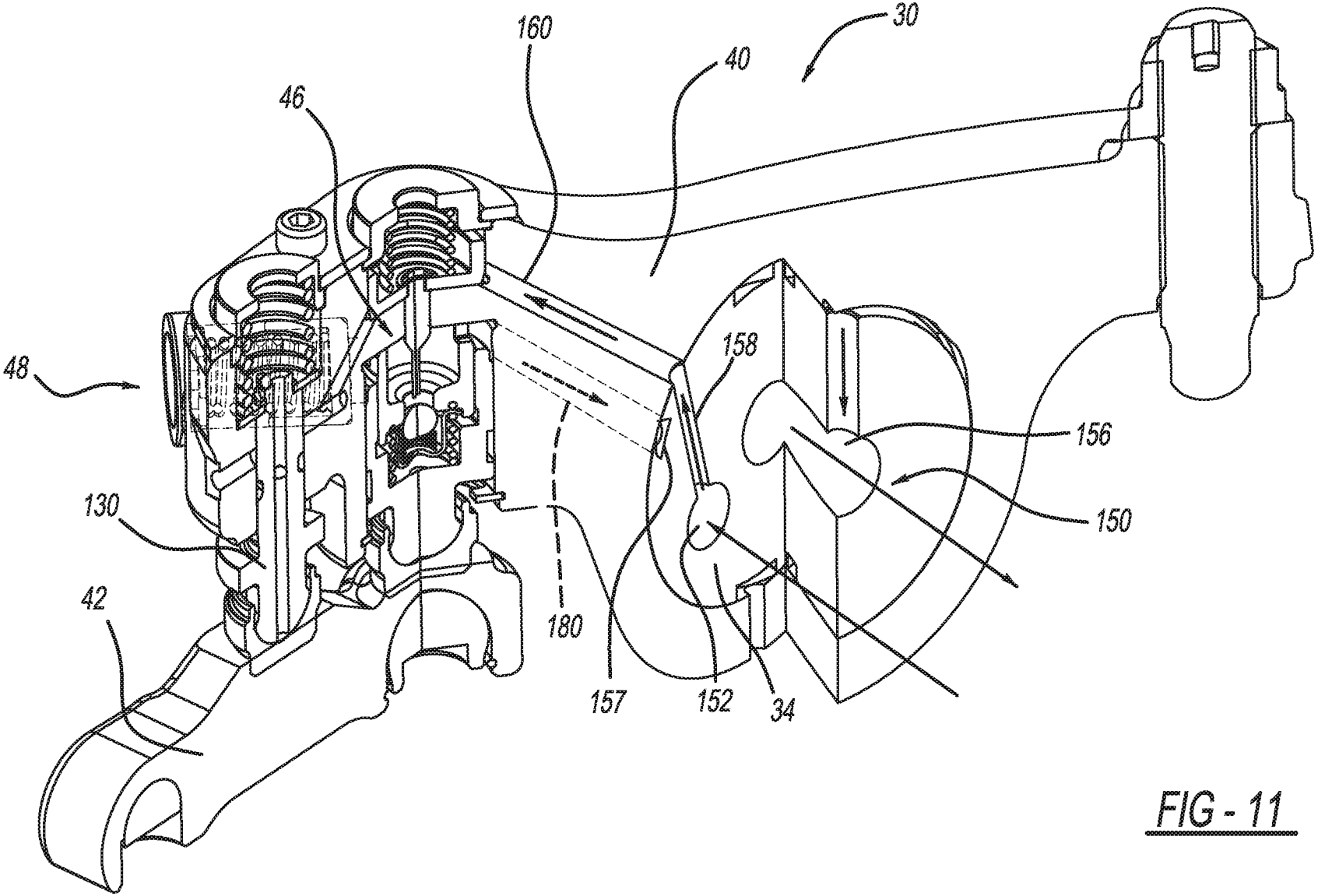
FIG. 11 is a sectional view of the exhaust rocker arm assembly taken along lines 11-11 of FIG. 1.

With reference now to FIGS. 4 and 9-11, an oil circuit 150 of the rocker arm assembly 20 will now be described. The rocker shaft 34 can define a central pressurized oil supply conduit 152, a vent oil passage or conduit 154, a lubrication conduit 156 and a lash adjuster oil conduit 180. The vent oil conduit 154 can have a vent lobe 157 extending generally parallel to an axis of the rocker shaft 34 and transverse to the vent oil conduit 154. A connecting passage 158 (FIG. 11) can connect the central pressurized oil supply conduit 152 with an oil supply passage 160 defined in the rocker arm 40. As discussed herein, the pressurized oil supply conduit 152, the connecting passage 158 and the oil supply passage 160 cooperate to supply pressurized oil to the second bore 104 to urge the upper disk portion 112 of the needle 100 upward. As the rocker arm 140 rotates around the rocker shaft 34, the vent lobe 157 will align with the oil supply conduit causing oil to be vented away from the second bore 104 through the vent oil conduit. When the pressure drops in the second bore 104, the second spring 120 will urge the needle 100 downward such that the longitudinal pin 110 will act against the ball 90 and move the ball away from the valve seat 76. Oil is then permitted to flow through the valve seat 76 and out of the HLA assembly 46 through the lash adjuster oil conduit 180 (FIG. 10).

Figure 3A:
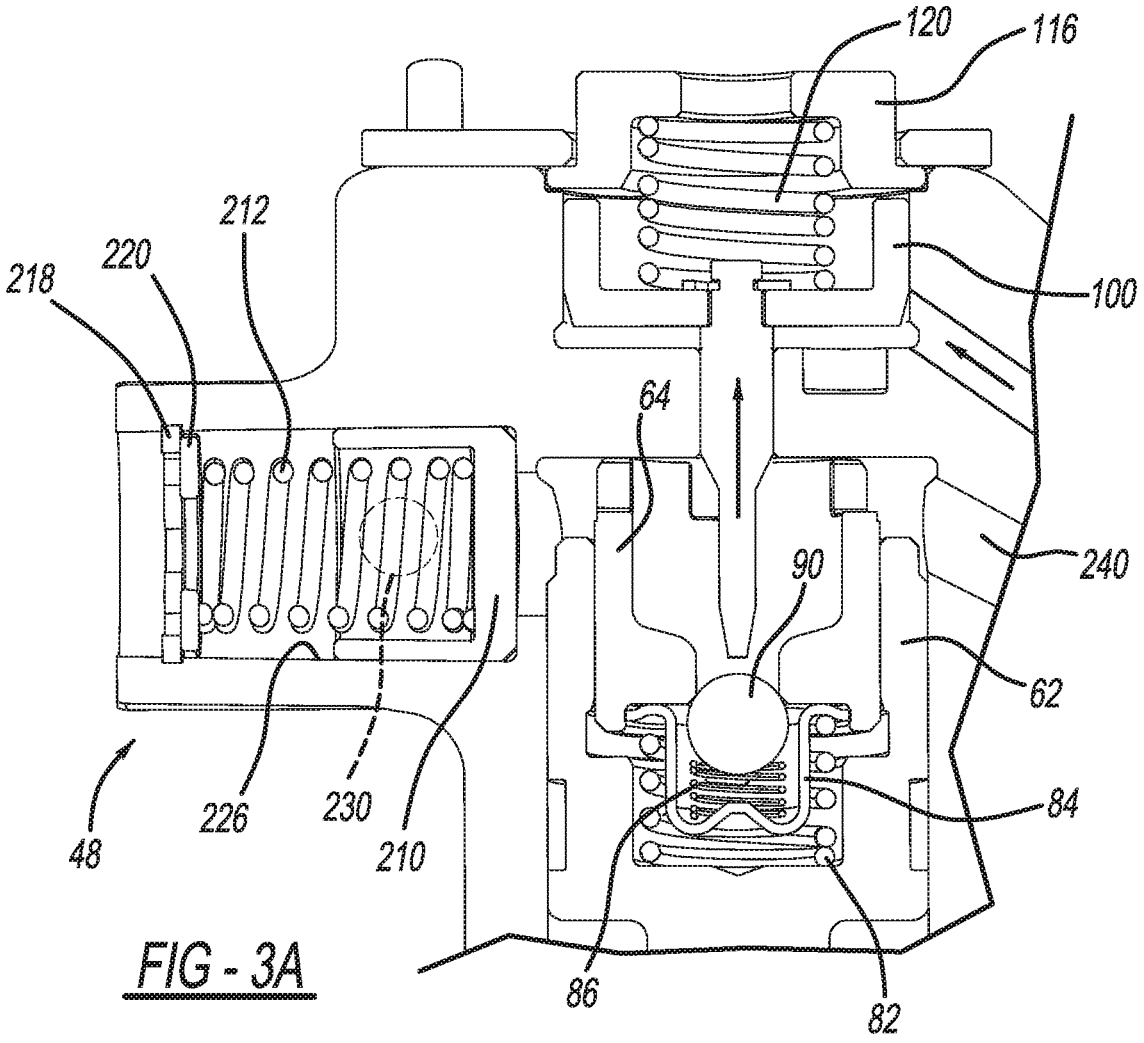
FIG. 3A is a schematic illustration of the exhaust valve rocker arm assembly of FIG. 3 and showing a cross-section taken through the accumulator assembly.

With particular reference now to FIGS. 2 and 3A, the accumulator assembly 48 will now be further described. The accumulator assembly 48 generally includes an accumulator piston 210, an accumulator spring 212, an accumulator snap ring 218 and an accumulator washer 220. The accumulator piston 210 slidably translates within a piston housing 226 that defines a release hole 230. As will become appreciated herein, the piston housing 226 provides an additional oil volume on the rocker arm 40. The accumulator piston 210 is normally pushed to its maximum extension (closed position) by the accumulator spring 212. When the HLA assembly 46 begins to collapse, a predetermined volume of oil is pushed into the piston housing 226 against the accumulator piston 210, moving the accumulator piston to an open position. This volume of oil is accumulated or stored within the piston housing 226 until the plunger assembly 60 sucks the oil back during the extension stroke. The accumulator piston 210 is configured to accumulate a limited amount of oil. Beyond the predetermined amount, any additional oil volume generated by an extended collapsing stroke of the plunger assembly 60 will push the accumulator piston 210 backward (leftward as viewed in FIG. 3A) until translating beyond the release hole 230. This additional oil is released through the release hole 230.

As will become appreciated herein, the exhaust rocker arm assembly 30 can operate in a default combustion engine mode with engine braking off and an engine braking mode (FIGS. 4-8). When the exhaust rocker arm assembly 30 is operating in the default combustion engine mode, an oil control valve 152 is closed (not energized). As a result, the oil supply passage 160 defined in the rocker arm 40 has low pressure such as around 0.3 bar. Other pressures may be used. With low pressure, the biasing member 120 will force the needle 100 in a downward direction causing the longitudinal pin portion 110 to urge the ball 90 away from the valve seat 76. The check ball assembly 80 is therefore open causing the HLA assembly 46 to become "soft" and not influencing a downward force upon the valve bridge 42. In the default combustion engine mode, rotation of the rocker arm 40 in the counter-clockwise direction will continue causing the collar 138 on the second spigot 130 to engage the rocker arm 40. Continued rotation of the rocker arm 40 will cause both the first and the second valves 50 and 52 to open together.

Figure 3B:
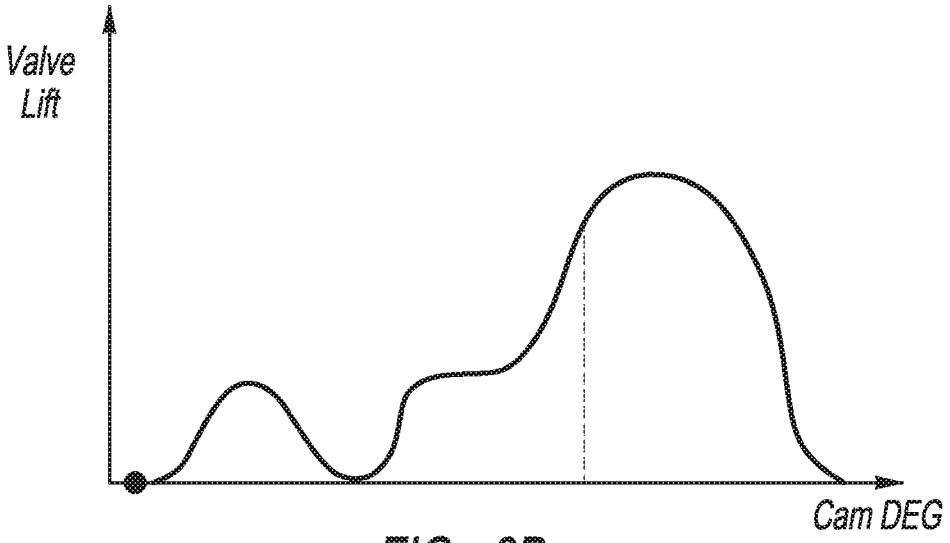
FIG. 3B is a plot illustrating valve lift versus cam degrees for the condition illustrated in FIGS. 3 and 3A.

With specific reference now to FIGS. 3-3B, operation of the exhaust valve rocker arm assembly 30 in the engine braking mode will be described. In braking mode, oil pressure is increased in oil supply passage 160 causing the needle 100 to move upward against the bias of the biasing member 120. As a result, the longitudinal pin portion 110 is moved away from the check ball 90. The HLA assembly 46 acts as a no-return valve with the first plunger body 62 rigidly extending toward the valve bridge 42. The first and second valves 50 and 52 are closed and the HLA assembly 46 is in contact with the valve bridge 42. Oil is flowing from connecting passage 158 to oil supply passage 160 causing the longitudinal pin portion 110 extending from the upper disk portion 112 to be urged upward keeping the check ball 90 closed and the HLA assembly 46 solid. As shown in FIG. 3A, oil is also reaching the HLA assembly 46 through passage 240 but the pressure is not high enough to move the piston 210. FIG. 3B identifies valve lift and cam degrees for the condition shown in FIGS. 3 and 3A.

Figure 4A:
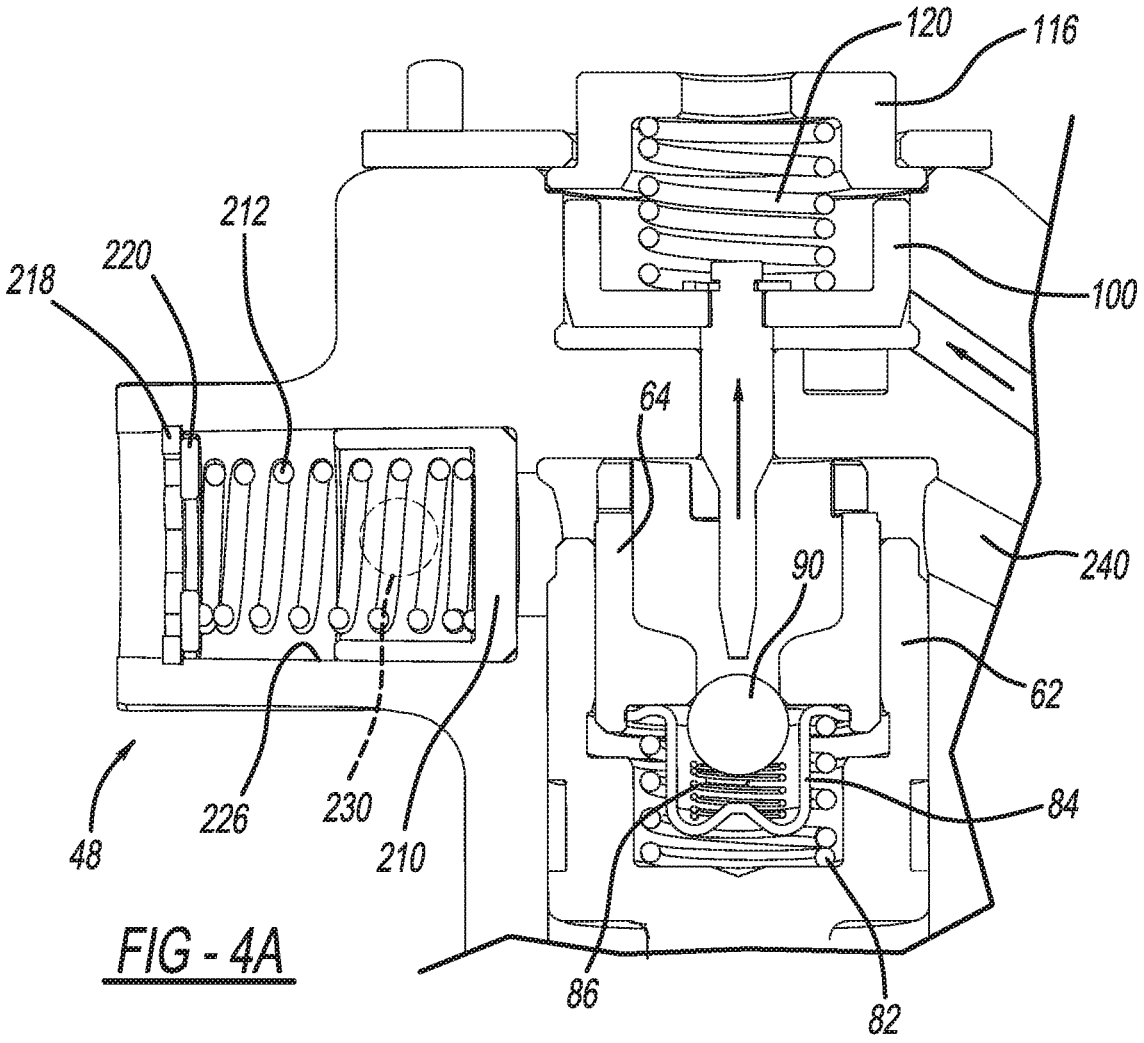
FIG. 4A is a schematic illustration of the exhaust valve rocker arm assembly of FIG. 4 and showing a cross-section taken through the accumulator assembly.
Figure 4B:
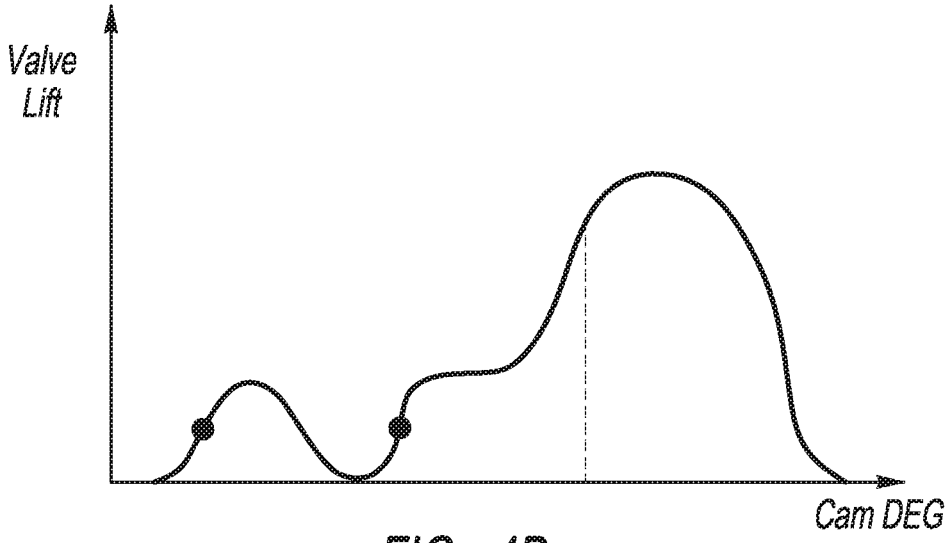
FIG. 4B is a plot illustrating valve lift versus cam degrees for the condition illustrated in FIGS. 4 and 4A.

Turning now to FIG. 4-4B, the rocker arm 40 has rotated further counter-clockwise around the rocker shaft 34. Oil is flowing from the connecting passage 158 to the oil supply passage 160 causing the longitudinal pin portion 110 to be urged upward keeping the check ball 90 closed and the HLA assembly 46 solid. As shown in FIG. 4A, oil is also reaching the HLA assembly 46 through the passage 240 but the pressure is not high enough to move the piston 210. FIG. 4B identifies valve lift and cam degrees for the condition shown in FIGS. 4 and 4A.

In the example shown, the rocker arm 40 has rotated 2.72 degrees. Because the HLA assembly 46 is rigid, the first spigot 70 will force the first socket 72 against the valve bridge 42 causing the first valve 50 to move off a first valve seat 170. In this example, the first valve 50 moves off the first valve seat 170 a distance of 2.85 mm. It will be appreciated that other distances (and degrees of rotation of the rocker arm 40) are contemplated. Notably, the second valve 52 remains closed against a second valve seat 172. The collar 138 on the second spigot 130, while traveling toward the rocker arm 40, has not yet reached the rocker arm 40. The second spigot 130 remains in contact (through the second socket 132) with the rocker arm 40.

Figure 5:
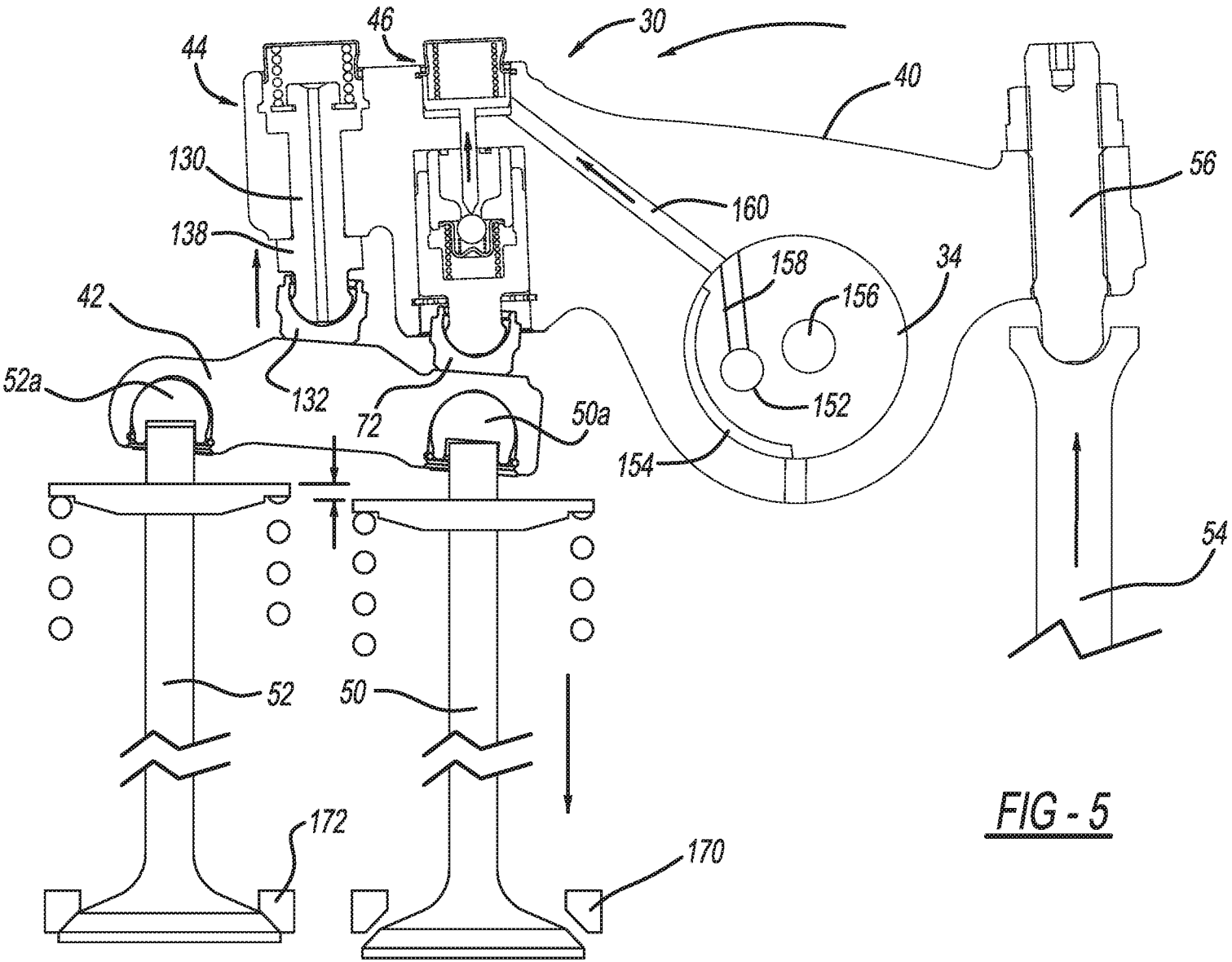
FIG. 5 is a schematic illustration of the exhaust valve rocker arm assembly of FIG. 4 and shown in engine brake mode with further rotation of the rocker arm in the counter-clockwise direction and with the first exhaust valve further opening.
Figure 5A:
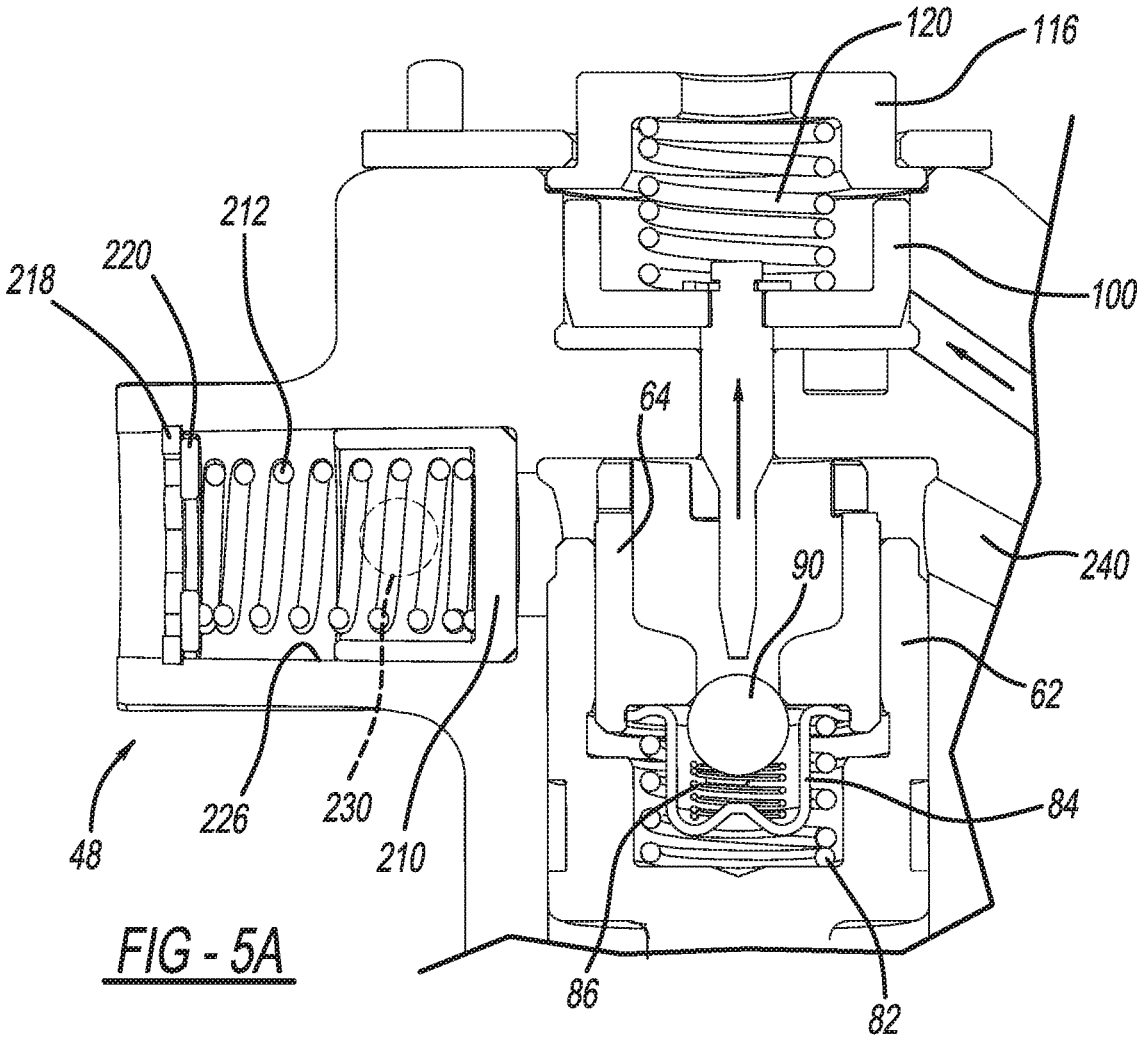
FIG. 5A is a schematic illustration of the exhaust valve rocker arm assembly of FIG. 5 and showing a cross-section taken through the accumulator assembly.
Figure 5B:
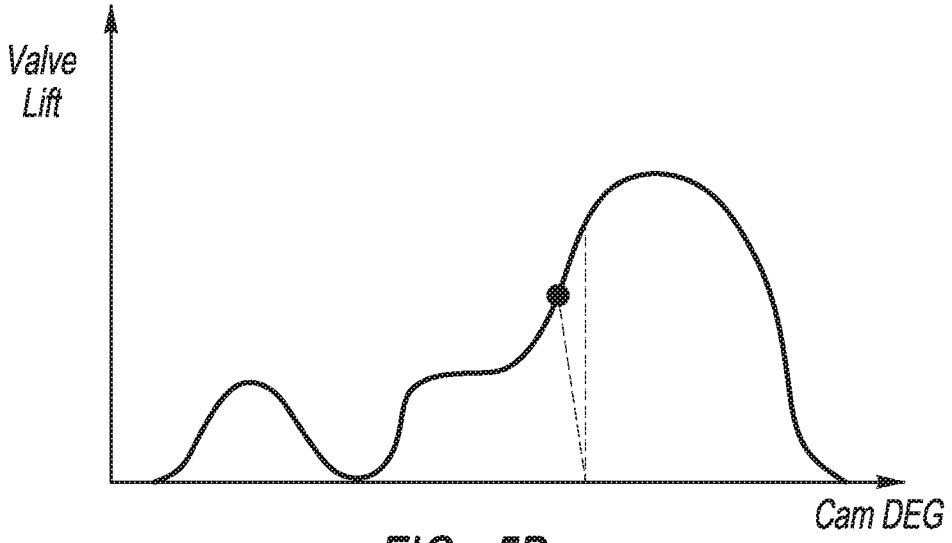
FIG. 5B is a plot illustrating valve lift versus cam degrees for the condition illustrated in FIGS. 5 and 5A.

With reference now to FIGS. 5-5B, the rocker arm 40 has rotated further counter-clockwise around the rocker shaft 34. In the example shown, the rocker arm 40 has rotated 4.41 degrees. Again, the HLA assembly 46 remains rigid and the first spigot 70 continues to force the first socket 72 against the valve bridge 42 causing the first valve 50 to move further off the first valve seat 170. In this example, the first valve 50 moves off the first valve seat 170 a distance of 4.09 mm. It will be appreciated that other distances (and degrees of rotation of the rocker arm 40) are contemplated. At this point the collar 138 has made contact with the rocker arm 40 and both the first and second valves 50 and 52 will be opened concurrently. As shown in FIG. 5A, oil is also reaching the HLA assembly 46 through the passage 240 but the pressure is not high enough to move the piston 210. FIG. 5B identifies valve lift and cam degrees for the condition shown in FIGS. 5 and 5A.

Figure 6:
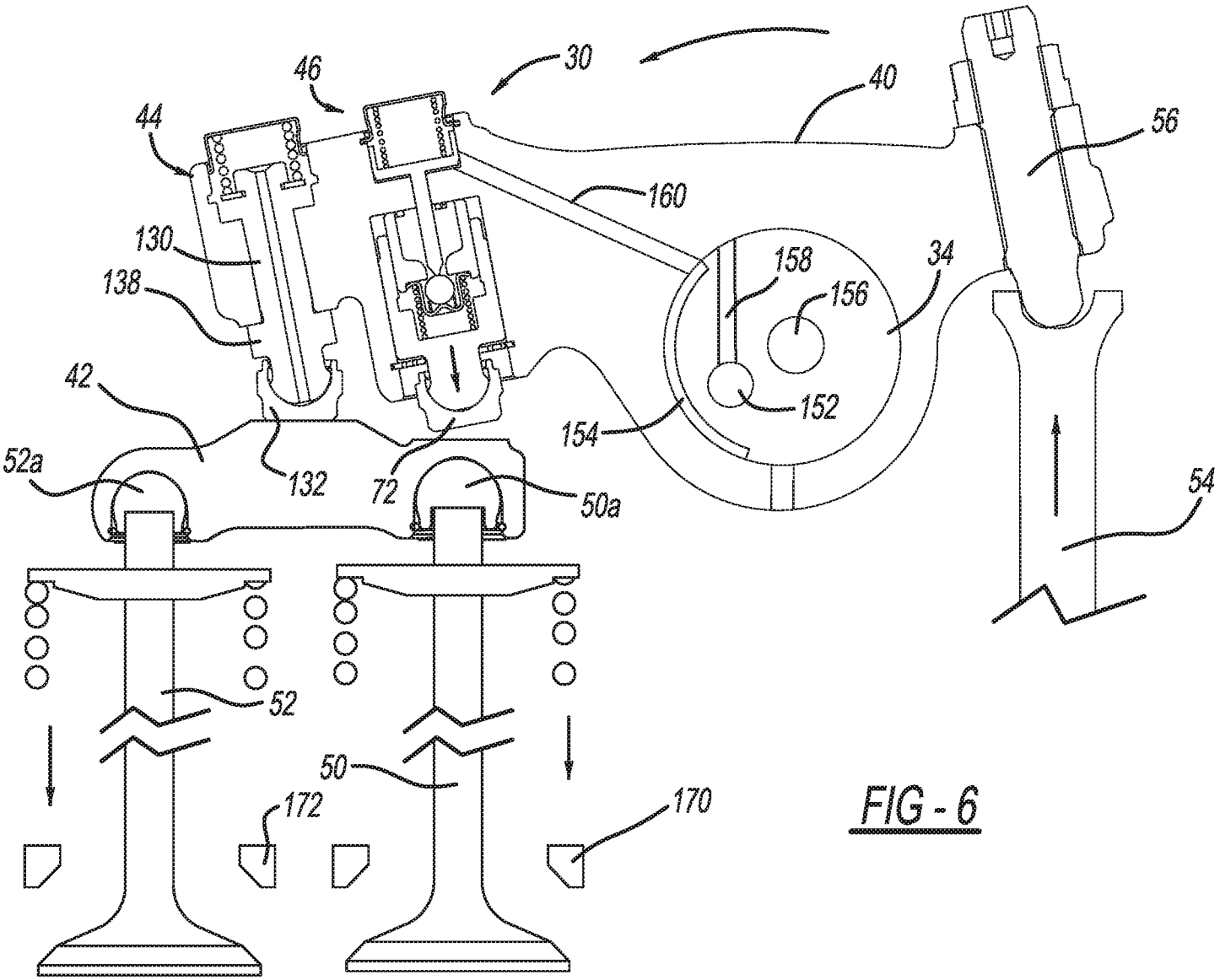
FIG. 6 is a schematic illustration of the exhaust valve rocker arm assembly of FIG. 5 and shown in engine brake mode with further rotation of the rocker arm in the counter-clockwise direction and shown with the first and a second exhaust valves both opened.
Figure 6A:
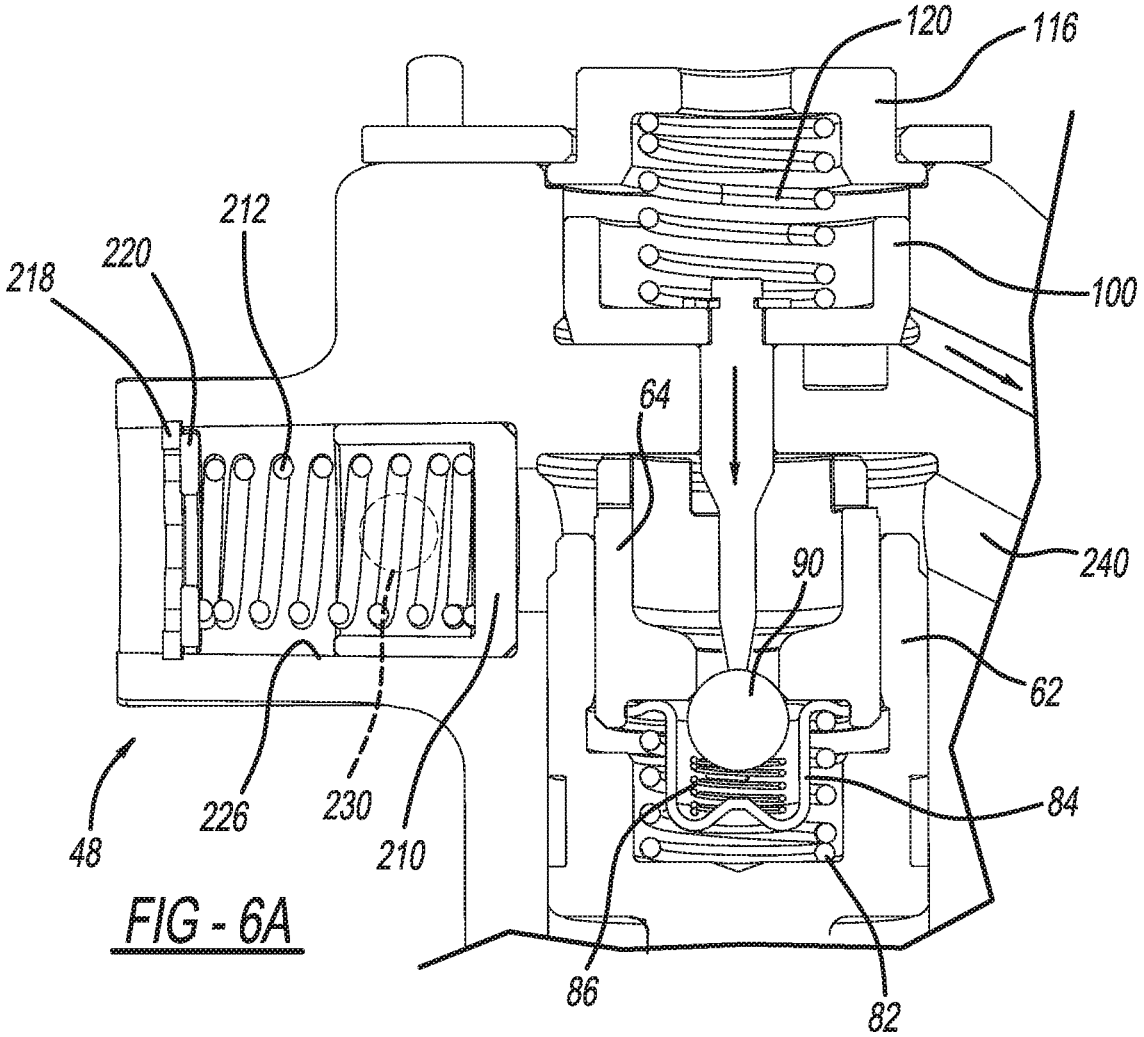
FIG. 6A is a schematic illustration of the exhaust valve rocker arm assembly of FIG. 6 and showing a cross-section taken through the accumulator assembly.
Figure 6B:
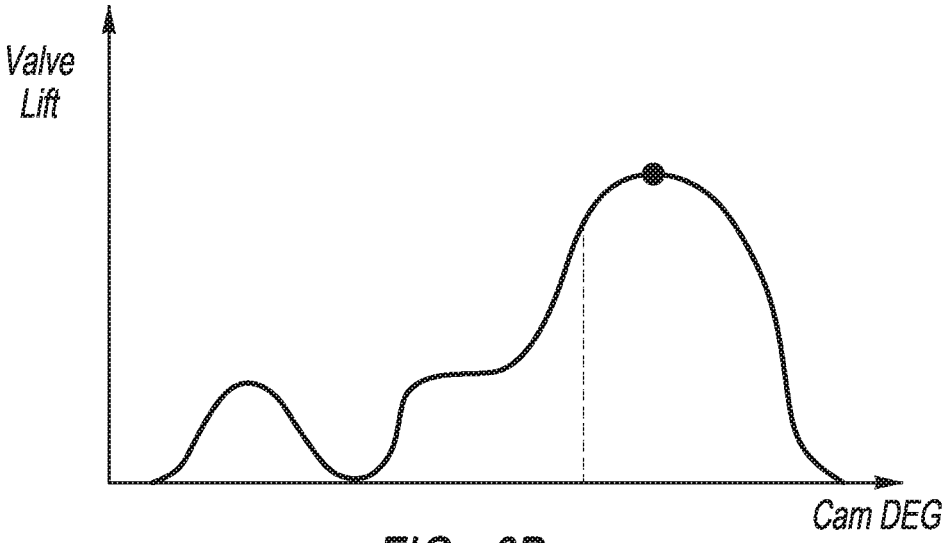
FIG. 6B is a plot illustrating valve lift versus cam degrees for the condition illustrated in FIGS. 6 and 6A.

With reference now to FIGS. 6-6B, the rocker arm 40 has rotated further counter-clockwise around the rocker shaft 34. In the example shown, the rocker arm 40 has rotated 12.9 degrees. At this point, the rocker arm 40 has rotated 12.9 degrees and the first and second valves 50 and 52 are at maximum lift off their valve seats 170 and 172. In the example shown the first and second valves 50 and 52 are displaced 15.2 mm off their respective valve seats 170 and 172. As shown, the oil supply passage 160 in the rocker arm 40 is fully disconnected from the connecting passage 158 of the central pressurized oil supply conduit 152 and is now connected to the vent oil conduit 154 by way of the vent lobe 157. In this position, the supply of pressurized oil is interrupted and the oil pressure will drop in the oil supply passage 160. As a result, the biasing member 120 urges the needle 100 downward such that the longitudinal pin portion 110 pushes the check ball 90 off the valve seat 76, opening the HLA assembly 46. Once the check ball 90 is open, the HLA assembly 46 becomes "soft" again and during valve closing will not exercise any force on the first valve 50 that could otherwise prevent its closing. Once the pushrod 54 occupies a position consistent with the base circle on the cam (not shown), the above process will continuously repeat until combustion mode is selected. As shown in FIG. 6A, oil is also reaching the HLA assembly 46 through the passage 240 but the pressure is not high enough to move the piston 210. FIG. 6B identifies valve lift and cam degrees for the condition shown in FIGS. 6 and 6A.

Figure 7:
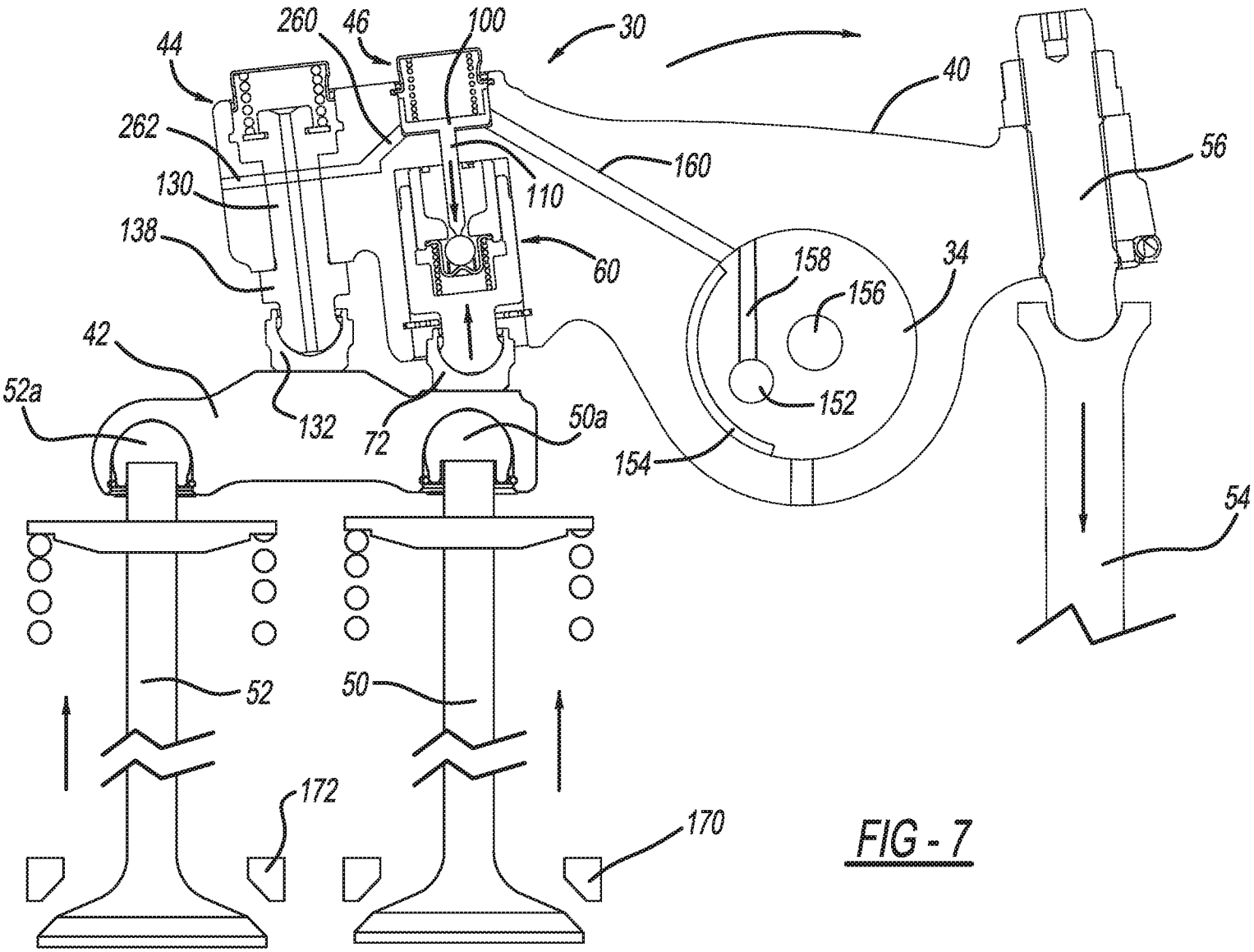
FIG. 7 is a schematic illustration of the exhaust valve rocker arm assembly of FIG. 6 and shown in engine brake mode with rotation of the rocker arm in the clockwise direction and with the valves closing pushing the capsule to collapse, the oil from the capsule flowing to the accumulator.
Figure 7A:
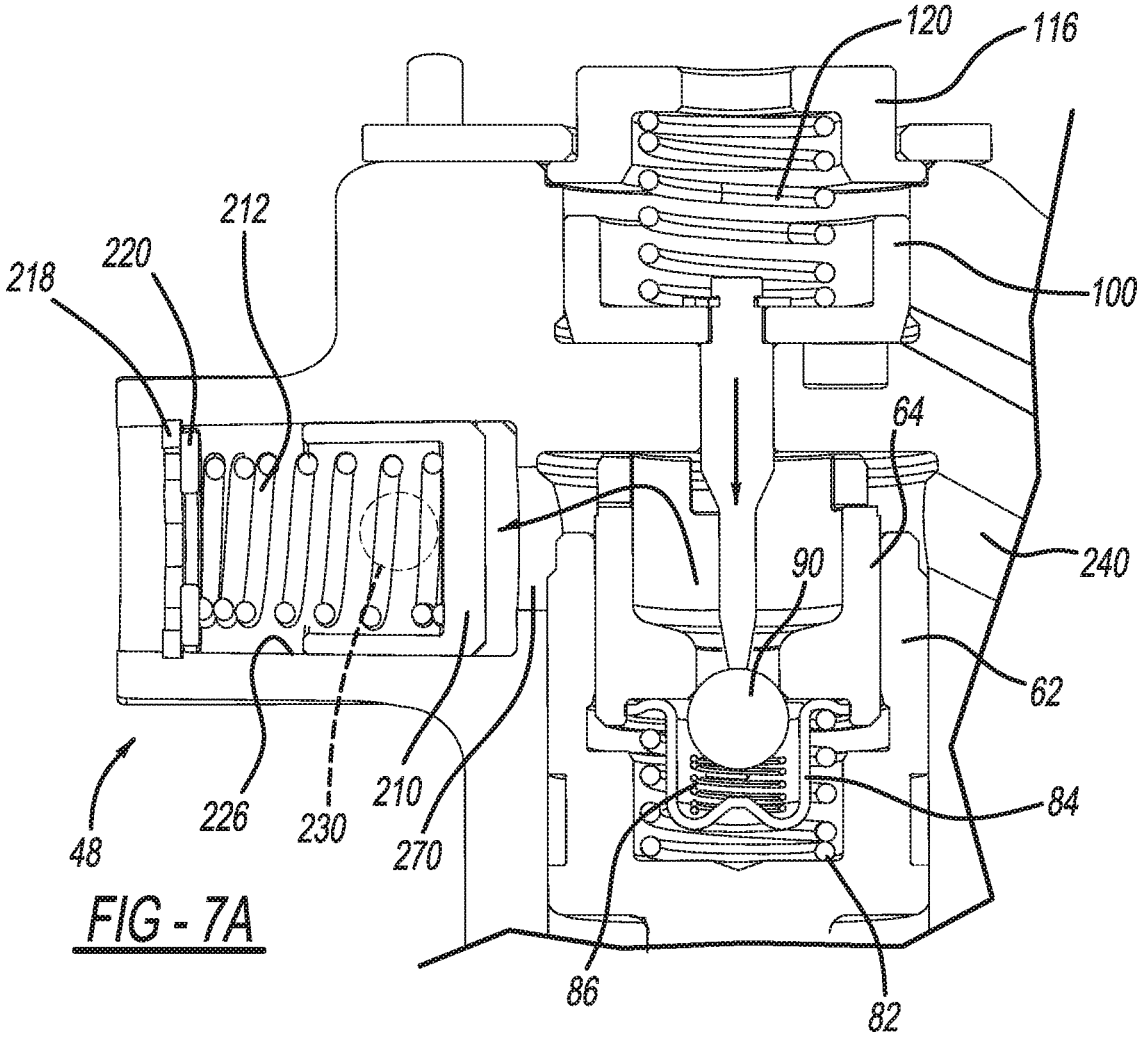
FIG. 7A is a schematic illustration of the exhaust valve rocker arm assembly of FIG. 7 and showing a cross-section taken through the accumulator assembly.
Figure 7B:
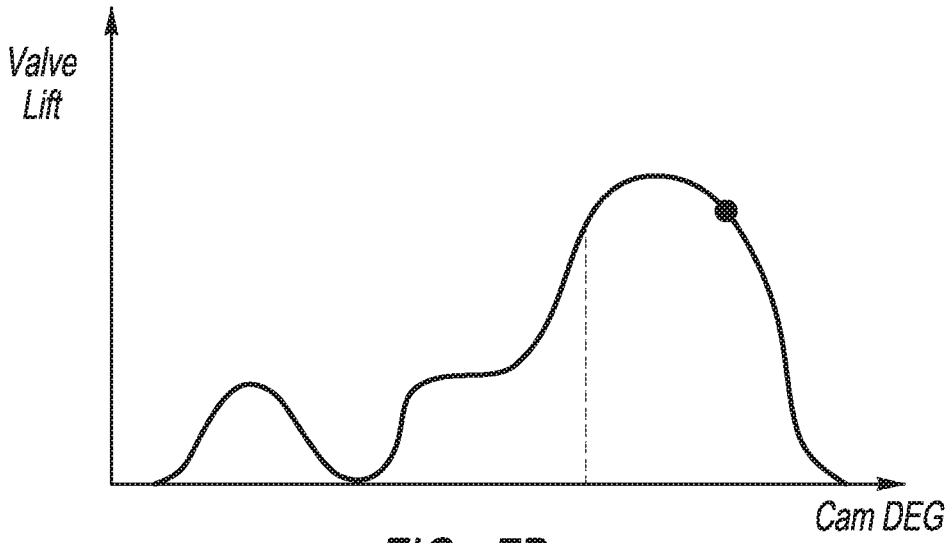
FIG. 7B is a plot illustrating valve lift versus cam degrees for the condition illustrated in FIGS. 7 and 7A.

Turning now to FIGS. 7-7B, the rocker arm 40 is rotating clockwise back through the closing side. The needle 100 stays downward because the pressurized oil coming from the oil supply passage 160 is released through a first and second auxiliary channel 260 and 262 and the HLA assembly 46 stays soft. During valve closure, the bridge 42 attains contact again with the plunger assembly 60 pushing it to compress. Oil released from the plunger assembly 60 is pushed through the passageway 270 (FIG. 7A). Pressure built up in the piston assembly 60 due to the piston assembly 60 compression is now able to move the accumulator piston 210 leftward as viewed in FIG. 7A. The oil coming from the first partial stroke of the piston assembly 60 is accumulated inside the volume open by the accumulator piston 210 stroke against the accumulator spring 212. FIG. 7B identifies valve lift and cam degrees for the condition shown in FIGS. 7 and 7A.

Figure 8:
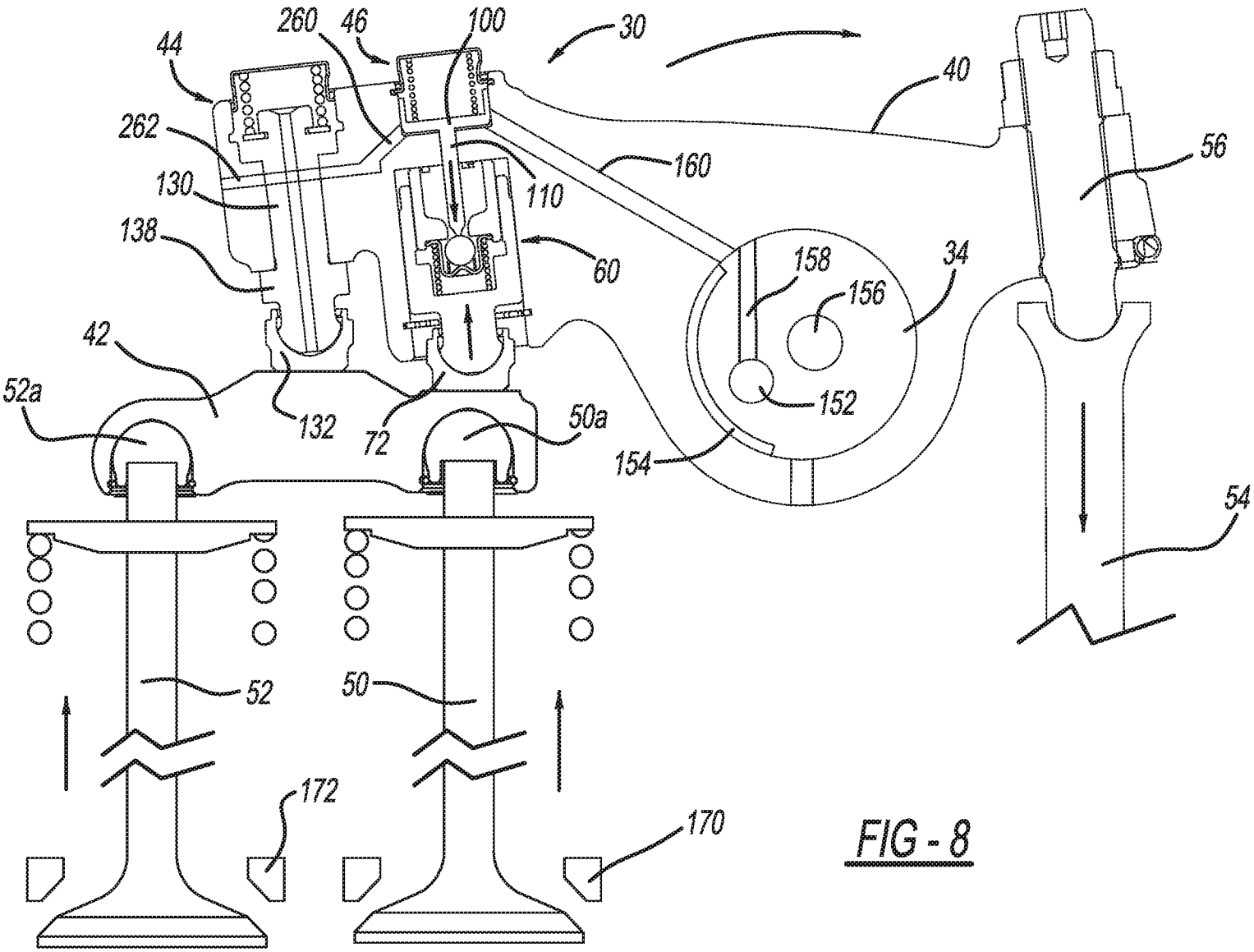
FIG. 8 is a schematic illustration of the exhaust valve rocker arm assembly of FIG. 7 and shown in engine brake mode with further rotation of the rocker arm in the clockwise direction and with both exhaust valves fully opened.
Figure 8A:
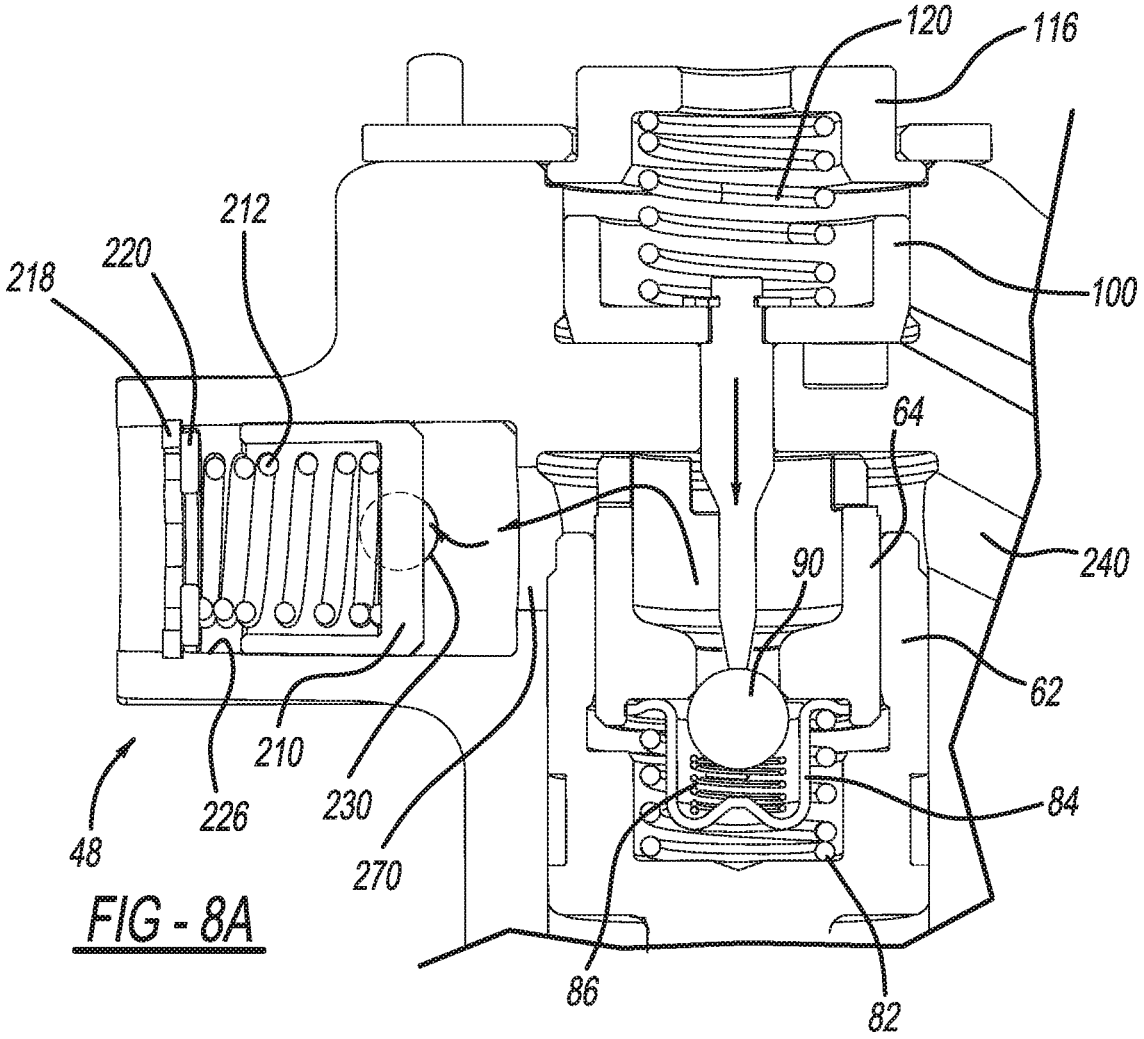
FIG. 8A is a schematic illustration of the exhaust valve rocker arm assembly of FIG. 8 and showing a cross-section taken through the accumulator assembly wherein the oil from the capsule is flowing to the accumulator and when the accumulator opens to a predetermined amount, additional oil is released through a release hole defined on the piston housing.
Figure 8B:
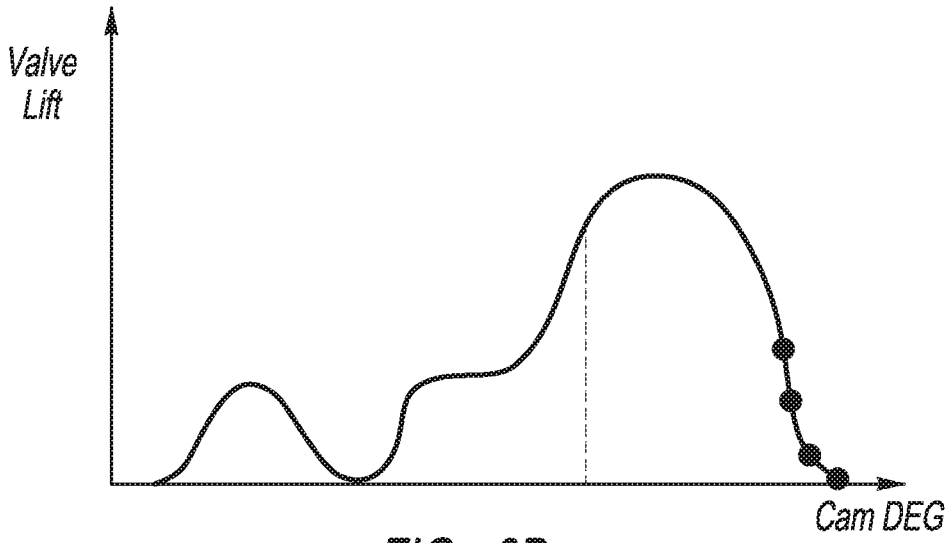
FIG. 8B is a plot illustrating valve lift versus cam degrees for the condition illustrated in FIGS. 8 and 8A.
Figure 9:
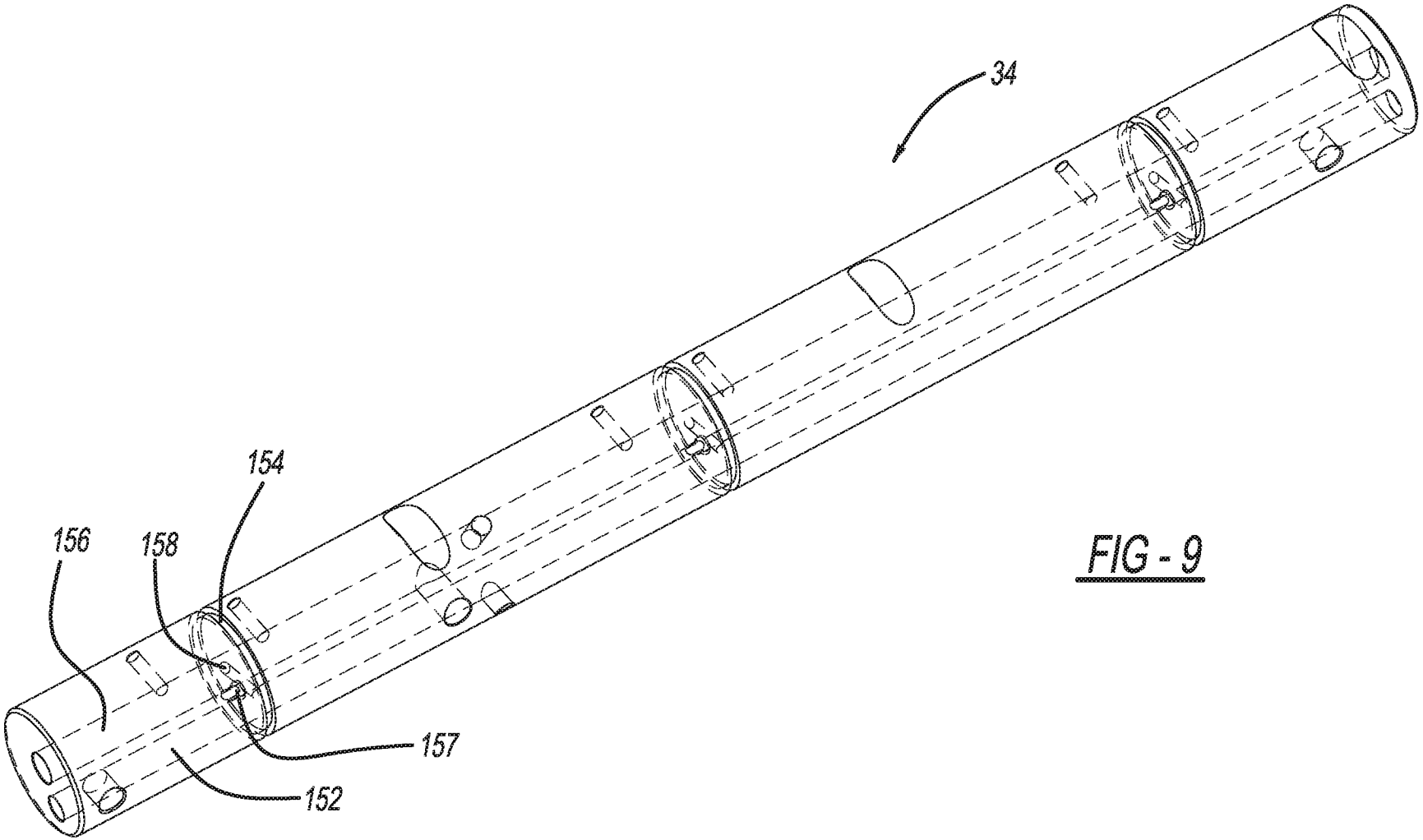
FIG. 9 is a perspective view of a rocker shaft of the rocker arm assembly of FIG. 1.

Turning now to FIGS. 8-8B, the rocker arm 40 continues to rotate clockwise back through the closing side. The needle 100 stays downward because the pressurized oil coming from the oil supply passage 160 is released through the first and second auxiliary channels 260 and 262 and the HLA assembly 46 stays soft. The piston assembly 60 is further pushed to compress and the oil released from the piston assembly 60 continues to flow through the passageway 270 (FIG. 8A). When the volume of oil exceeds a defined amount, the stroke of the accumulator piston 210 is sufficient to open the release hole 230 on the piston housing 226 allowing to release the excessive amount of oil coming from the piston assembly 60 collapsing.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. An exhaust valve rocker arm assembly operable in a combustion engine mode and an engine braking mode, the exhaust valve rocker arm assembly comprising:

a rocker shaft that defines a pressurized oil supply conduit;

a rocker arm that receives the rocker shaft and is configured to rotate around the rocker shaft, the rocker arm having an oil supply passage and an accumulator piston housing defined therein;

a valve bridge that engages a first exhaust valve and a second exhaust valve;

a hydraulic lash adjuster assembly disposed on the rocker arm having a first plunger body and a second plunger body having an opening that defines a valve seat, the first plunger body movable relative to the second plunger body between a first position in the engine braking mode and a second position in the combustion mode, wherein in the first position, the first plunger body extends rigidly for cooperative engagement with the valve bridge;

a check valve disposed on the rocker arm at least partially between the first and second plunger bodies and having an actuator that selectively releases pressure in the hydraulic lash adjuster, the check valve having a check ball that seats against the valve seat during engine braking mode precluding oil from flowing through the opening; and an accumulator assembly disposed in the rocker arm and including an accumulator piston that translates within the accumulator piston housing between closed and open positions, the accumulator assembly configured to store a predetermined amount of oil when the first plunger body moves relative to the second plunger body toward the second position.

2. The exhaust valve rocker assembly of claim 1 wherein the accumulator assembly further comprises an accumulator spring that biases the accumulator piston toward the closed position, wherein in the closed position, oil is inhibited from entering the accumulator piston housing.

3. The exhaust valve rocker assembly of claim 2 wherein the accumulator assembly further defines a release hole formed in the rocker arm that fluidly connects with the piston housing, wherein oil is released from the piston housing through the release hole upon the accumulator piston translating a predetermined amount.

4. The exhaust valve rocker assembly of claim 3 wherein in the engine braking mode, pressurized oil is communicated through the pressurized oil supply conduit, through the rocker arm oil supply passage and against the actuator such that the first plunger occupies the first position and acts on the valve bridge during rotation of the rocker arm to a first angle opening the first exhaust valve a predetermined distance while the second exhaust valve remains closed.

5. The exhaust valve rocker assembly of claim 1 wherein the hydraulic lash adjuster assembly is at least partially received by a first bore defined on the rocker arm and wherein the second plunger body is at least partially received by the first plunger body.

6. The exhaust valve rocker assembly of claim 1 wherein the actuator further comprises a needle having a longitudinal pin portion and a disk portion, wherein in the engine braking mode, pressurized oil acts against the disk portion moving the longitudinal pin portion a distance away from the check ball.

7. The exhaust valve rocker assembly of claim 6 wherein the disk portion of the actuator is received in a second bore defined in the rocker arm, wherein the first and second bores are collinear.

8. The exhaust valve rocker assembly of claim 1 wherein rotation of the rocker arm to a second predetermined angle disconnects the oil supply passage from the pressurized oil supply conduit.

9. The exhaust valve rocker assembly of claim 1, further comprising a spigot disposed on the rocker arm, wherein in the engine braking mode, subsequent to the opening of the first valve the predetermined distance, further rotation of the rocker arm causes the spigot to move the valve bridge and open the second valve while further opening the first valve.

10. The exhaust valve rocker assembly of claim 9 wherein the spigot is configured to slidably translate along a passage defined in the rocker arm prior to moving the valve bridge.

11. An exhaust valve rocker arm assembly operable in a combustion engine mode and an engine braking mode, the exhaust valve rocker arm assembly comprising:

a rocker shaft that defines a pressurized oil supply conduit;

a rocker arm that receives the rocker shaft and is configured to rotate around the rocker shaft, the rocker arm having an oil supply passage and an accumulator piston housing defined therein;

a valve bridge that engages a first exhaust valve and a second exhaust valve;

a plunger assembly including a first plunger body and a second plunger body having an opening that defines a valve seat, the first plunger body movable relative to the second plunger body between a first position wherein a check ball seats against the valve seat precluding oil from flowing through the opening in the engine braking mode and a second position wherein the check ball is offset from the valve seat permitting oil to flow through the opening in the combustion mode, wherein in the first position, the first plunger body extends rigidly for cooperative engagement with the valve bridge;

an actuator that selectively moves the check ball off the valve seat; and an accumulator assembly disposed in the rocker arm and including an accumulator piston that translates within the accumulator piston housing between closed and open positions, the accumulator assembly configured to store a predetermined amount of oil when the first plunger body moves toward the second position.

12. The exhaust valve rocker assembly of claim 11 wherein the accumulator assembly further comprises an accumulator spring that biases the accumulator piston toward the closed position, wherein in the closed position, oil is inhibited from entering the accumulator piston housing.

13. The exhaust valve rocker assembly of claim 12 wherein the accumulator assembly further defines a release hole formed in the rocker arm that fluidly connects with the piston housing, wherein oil is released from the piston housing through the release hole upon the accumulator piston translating a predetermined amount.

14. The exhaust valve rocker assembly of claim 13 wherein in the engine braking mode, pressurized oil is communicated through the pressurized oil supply conduit, through the rocker arm oil supply passage and against the actuator such that the first plunger occupies the first position and acts on the valve bridge during rotation of the rocker arm to a first angle opening the first exhaust valve a predetermined distance while the second exhaust valve remains closed.

15. The exhaust valve rocker assembly of claim 11 wherein rotation of the rocker arm to a second predetermined angle disconnects the oil supply passage from the pressurized oil supply circuit.

16. The exhaust valve rocker assembly of claim 11 wherein the rocker shaft further defines a vent channel, and wherein rotation of the rocker arm to a third predetermined angle connects the oil supply passage to a vent channel releasing the oil pressure from the actuator.

17. The exhaust valve rocker assembly of claim 11, further comprising a spigot disposed on the rocker arm, wherein in the engine braking mode, subsequent to the opening of the first valve the predetermined distance, further rotation of the rocker arm causes the spigot to move the valve bridge and open the second valve while further opening the first valve.

18. The exhaust valve rocker assembly of claim 11, wherein the second plunger body is at least partially received by the first plunger body, wherein a check valve is disposed between the first and second plunger bodies, the check valve further comprising the check ball that selectively seats against the valve seat on the second plunger body.

19. The exhaust valve rocker assembly of claim 11 wherein the actuator further comprises a needle having a longitudinal pin portion and a disk portion, wherein in the engine braking mode, pressurized oil acts against the disk portion moving the longitudinal pin portion a distance away from the check ball wherein the disk portion of the actuator is received in a second bore defined in the rocker arm, wherein the first and second bores are collinear.

* * * * *